US010138611B2

(12) United States Patent
Anh

(10) Patent No.: US 10,138,611 B2
(45) Date of Patent: Nov. 27, 2018

(54) PRESSURE DIFFERENTIAL OPEN DIKE EQUIPMENT AND OPEN DIKE SYSTEM TO LIMIT EFFECTS OF TIDE ON UPSTREAM AREAS

(71) Applicant: IRT & Associates, Inc., Houston, TX (US)

(72) Inventor: Nguyen Cong Anh, Houston, TX (US)

(73) Assignee: IRT & Associates, Inc., Houston, TX (US)

( * ) Notice: Subject to any disclaimer, the term of this patent is extended or adjusted under 35 U.S.C. 154(b) by 407 days.

(21) Appl. No.: 14/837,158

(22) Filed: Aug. 27, 2015

(65) Prior Publication Data

US 2017/0058473 A1 Mar. 2, 2017

(51) Int. Cl.
*E02B 7/40* (2006.01)
*E02B 7/44* (2006.01)

(52) U.S. Cl.
CPC . *E02B 7/40* (2013.01); *E02B 7/44* (2013.01)

(58) Field of Classification Search
CPC ..... E02B 3/10; E02B 7/44; E02B 7/42; E02B 7/40
USPC ..... 405/21, 30–32, 87–89, 92, 94, 99
See application file for complete search history.

(56) References Cited

U.S. PATENT DOCUMENTS 13,622 A * 10/1855 Linkletter ..... B65G 27/04 198/752.1
1,084,454 A 1/1914 Liljegran
1,389,212 A 8/1921 Parker
3,345,823 A * 10/1967 Rakcevic ..... F03B 3/183 405/99
3,490,239 A 1/1970 Vincent
3,724,221 A 4/1973 Cool
(Continued)

FOREIGN PATENT DOCUMENTS

DE 3433966 A1 * 3/1986
DE 3621416 A1 * 1/1988
(Continued)

OTHER PUBLICATIONS

PCT Sep. 16, 2016 International Search Report and Written Opinion mailed in International Patent Application No. PCT/US2016/040616 filed Jul. 1, 2016.
PCT Oct. 14, 2016 International Search Report and Written Opinion mailed in International Patent Application No. PCT/US16/40374 filed Jun. 30, 2016.
(Continued)

*Primary Examiner* — Sunil Singh
(74) *Attorney, Agent, or Firm* — Foley & Lardner LLP; Terrell R. Miller; Teresa J. Lechner-Fish

(57) ABSTRACT

An open breakwater dike system comprising a dike body, anchor feet, wherein the anchor feet are connected to or integral with a bottom surface of the dike body; and a first pillar connected to or integral with an upper surface of the dike body is disclosed. In an embodiment, the open dike system further comprises a second pillar connected to or integral with the upper surface of the dike body offset from the first pillar; a first flap gate rotationally attached to the first pillar and disposed between the first and second pillars, wherein the first flap gate closes against a first extension in the second pillar; and a means for opening and closing one or more flap gates, wherein the means for opening one or more flap gates opens and closes the first flap gate. A method of using the open breakwater dike system is also disclosed.

25 Claims, 24 Drawing Sheets

(56) References Cited

U.S. PATENT DOCUMENTS

| | | | |
|---|---|---|---|
| 4,129,006 | A | 12/1978 | Payne |
| 4,146,346 | A | 3/1979 | Salo |
| 4,367,978 | A | 1/1983 | Schaaf et al. |
| 4,711,598 | A | 12/1987 | Schaaf et al. |
| 5,393,169 | A | 2/1995 | Creter |
| 5,509,755 | A | 4/1996 | Olsen et al. |
| 5,713,699 | A | 2/1998 | Obermeyer et al. |
| 5,888,020 | A | 3/1999 | Brais et al. |
| 2008/0101867 | A1 | 5/2008 | McLaughlin |
| 2009/0169306 | A1 | 7/2009 | Rijlaarsdam |
| 2012/0163916 | A1 | 6/2012 | Waters, Jr. |
| 2013/0209173 | A1 | 8/2013 | Quek |
| 2014/0270963 | A1 | 9/2014 | Lopez et al. |

FOREIGN PATENT DOCUMENTS

| | | | | |
|---|---|---|---|---|
| JP | 2001-348848 | A | * | 12/2001 |
| JP | 2004-245012 | A | | 9/2004 |
| JP | 2008190200 | A | * | 8/2008 |
| JP | 201571857 | A | * | 4/2015 |
| KR | 2012085358 | A | * | 8/2012 |
| WO | WO-2012/009966 | A1 | | 1/2012 |
| WO | WO 2013157922 | A1 | * | 10/2013 |

OTHER PUBLICATIONS

PCT Feb. 16, 2017 International Search Report and Written Opinion mailed in International Patent Application No. PCT/US2016/048956 filed Aug. 26, 2016.

* cited by examiner

PRIOR ART

PRESSURE DIFFERENTIAL OPEN DIKE EQUIPMENT AND OPEN DIKE SYSTEM TO LIMIT EFFECTS OF TIDE ON UPSTREAM AREAS

PRIOR RELATED APPLICATIONS

Not Applicable (N/A)

FEDERALLY SPONSORED RESEARCH STATEMENT

N/A

REFERENCE TO MICROFICHE APPENDIX

N/A

FIELD OF INVENTION

This invention relates generally to the construction and environment field, in particular, open breakwater dike equipment and system, and water pressure differential equipment and system to reduce tide water levels upstream.

BACKGROUND OF THE INVENTION

Currently, climate change is causing sea and tide levels to rise which affects water levels on rivers, lakes, bays/coast areas; causing inundation and flooding on sea side and river side cities. Many large cities are located near rivers or within 100 km of the shore such as Bangkok, Houston, London, New York, Rotterdam, San Francisco, Saigon, Venice, etc. As a result, these cities are vulnerable to attack from high tide and/or storm surge. To solve these problems, infrastructure solutions such as dams or dikes are favored throughout the world, including Germany, Japan, Netherlands, United States, etc., or infrastructure solutions such as detention lakes or ponds, reforestation, etc. Each solution has its different advantages and disadvantages. These infrastructures are typically located at bay entrances, estuaries of major rivers or within the river.

To find a solution to the two types of high waves (i.e., tide and storm surge) discussed above, the challenge is to solve the large damaging potential on both scale and space of the waves. Previously, to counter wave damages, large scale infrastructure solutions such as dams, dikes and erect ground features through land leveling were typically implemented. The characteristics of such large scale solutions include extreme economic cost along with side issues of major landscape and surface modification, altering the nutritional exchanging processes of the zone (e.g., drainage) behind the protective structure. Such characteristics were only realized to be detrimental long afterwards and were consequently considered to be less than ideal, multiple regret solutions. This is a scientific conclusion from geographical regions utilizing solid infrastructures to counter sea level problems such as Japan, Netherlands, Thailand and the Eastern Northern European region neighboring Russia.

Existing dike systems often have flap gates to allow water vehicles to travel along the water body, creating the navigable channel. However, any major type of dike system when operating would require its flap gates to be closed, blocking the navigable channel. In storm situations, existing dike systems when operating would also require its flap gates to be closed to block out storm surges, blocking the navigable channel and forcing ships or water vehicles to dock along the shore. The economic damage from delayed transportation and direct storm damage is very high. The closed flap gates also prevent upstream water to discharge to the sea, causing upstream cities behind the existing dike systems to be inundated.

As described above, the construction of solid dikes are costly in terms of labor, materials, supplies, etc. Further, the navigable waterway is constricted since the wider the channel is built, the more materials would be required. Mega structures such as the dike systems with flap gates in the Netherlands are extremely expensive. The greatest disadvantage of this type of dike system is preventing the natural flow of water and hence, preventing the self-purification process of the water body inside the dike. Thus, this type of dike solution is often considered to be "less than ideal" and termed a "multi regret solution" by engineering experts.

Based upon these valuable experiences, the United Nations recently adopted a more "environmentally friendly" perspective in response to rising sea levels, emphasizing non infrastructure solutions mirroring nature (e.g., detention lakes or ponds, protective forests, etc.). The psychological benefits of these non-infrastructure solutions are superior; however, the disadvantages include high implementation cost, lengthy preparation time and ongoing pursuit of the plan's environmental perspective.

Thus, to meet the requirements of sustainable social development, another supplementary infrastructure solution must be prioritized to mitigate damage, namely, to life and property, as well as to the living and manufacturing environment.

SUMMARY OF THE INVENTION

This invention relates generally to the construction and environment field, in particular, the open breakwater dike equipment and system, and water pressure differential equipment and system to reduce tide water levels upstream.

The purpose of the invention is to lower the flow velocity of tide water from sea to inland rivers, and, at the same time, reduce the tide water inflow volume into the river to less than or equal to about 30% or to within a deviation coefficient of about 30% while retaining about 100% outflow volume.

To achieve these targets, the present invention comprises open breakwater dike equipment with water pressure differential, including:

- A kinetic energy reducing section (e.g., pillars), installed to a base structure (e.g., dike body), including a horizontal/vertical rotating section (e.g., flap gates) with force receiving section to receive kinetic energy of flow, which does not block flow but only reduces tide flow velocity. Further, the kinetic energy reducing section is located at a position that does not reduce the flow velocity at low tide;
- A frame, including weights, is connected with the kinetic energy reducing section (e.g., flap gates, pillars) to limit the tide flow velocity of the under current and to protect the river bottom; and
- An anchor (e.g., anchor feet), including wires, fix the position of the base structure (e.g., dike body) to the river bottom.

In an embodiment, an open dike system is disclosed. The open dike system includes a dike body having a first end and a second end and a first side and a second side; a plurality of anchor feet, wherein the plurality of anchor feet may be connected to or integral with a bottom surface of the dike body; and a first pillar connected to or integral with an upper surface along the first end or the first side of the dike body.

In an embodiment, the open dike system further includes a second pillar connected to or integral with the upper surface of the dike body offset from and approximately parallel to the first pillar; a first flap gate rotationally attached to the first pillar and disposed between the first and second pillars, wherein the first flap gate closes against a first extension in the second pillar; and a means for opening and closing one or more flap gates, wherein the means for opening one or more flap gates opens and closes the first flap gate.

In an embodiment, the open dike system further includes, a third pillar connected to or integral with the upper surface of the dike body offset from and approximately parallel to the second pillar; a second flap gate rotationally attached to the second pillar and disposed between the second and third pillars, wherein the second flap gate closes against a second extension in the third pillar, and wherein the means for opening one or more flap gate opens and closes the second flap gate.

In an embodiment, the dike body may be constructed as a hollow structure, a solid structure or a dense solid structure.

In an embodiment, the dike body may be constructed as a hollow or solid structure capable of functioning as a packet boat.

In an embodiment, the dike body may be constructed as a dense solid structure.

In an embodiment, one or more of the anchor feet, the dike body and the pillar may be constructed of biological materials, non-biological materials and combinations thereof.

In an embodiment, one or more of the anchor feet, the dike body and the pillar may be constructed of composites, concrete, metals, polymers and combinations thereof.

In an embodiment, the flap gate may be constructed as a single, a two part or a multi-part structure.

In an embodiment, the flap gate has a two part structure, wherein the means for opening and closing one or more flap gates opens and closes a lower part of the flap gate, and wherein water force opens and closes an upper part of the flap gate.

In an embodiment, the flap gate is constructed of cavitation resistant material.

In an embodiment, the flap gate is constructed of vulcanized rubber.

In an embodiment, the means for opening and closing one or more flap gates includes a flap gate rotor attached to the first pillar; and a flexible arm structure having a first end and a second end, wherein the first end of the flexible arm structure is flexibly attached to the flap gate rotor and the second end of the flexible arm structure may be flexibly attached to the first gate.

In an embodiment, the flap gate rotor may be controlled by electricity, hydraulics, water force and combinations thereof.

In an embodiment, the open dike system includes a first trash net and a first structural frame, wherein the first trash net may be attached to the first structural frame and the first structural frame may be attached to an upper surface along the first side of the dike body; and a second trash net and a second structural frame, wherein the second trash net may be attached to the second structural frame and the second structural frame may be attached to an upper surface along the second side of the dike body.

In an embodiment, the first structural frame may be offset from an edge of the first side of the dike body and the second structural frame may be offset from an edge of the second side of the dike body to both be positioned more closely to the one or more flap gates.

In an embodiment, a method of using an open dike system is disclosed. The method includes the steps of: using one or more open dike system; positioning the one or more open dike system in a layout along a river; and reducing tide inflow volume in the river while maintaining outflow volume.

In an embodiment, the layout may be selected from the group consisting of dual sided, asymmetric chevrons, dual sided asymmetric rows, dual sided symmetric chevrons, dual sided symmetric rows, single sided rows, single sided chevrons and combinations thereof.

In an embodiment, the tide inflow volume may be reduced to less than or equal to about 40% while the outflow volume may be maintained at greater than or equal to about 90%.

In an embodiment, the tide inflow volume may be reduced to less than or equal to about 30% while outflow volume may be maintained at greater than or equal to about 95%.

In an embodiment, the method further includes the steps of positioning one or more flap gates across a navigable channel in a dual sided open dike system, wherein the layout may be selected from the group consisting of dual sided, asymmetric chevrons, dual sided asymmetric rows, dual sided symmetric chevrons, dual sided symmetric rows and combinations thereof; and opening the one or more flap gates to allow large ships or water vehicles to travel upstream.

In an embodiment, the method further includes using bottom protection downstream or upstream of the one or more open dike systems.

These and other objects, features and advantages will become apparent as reference is made to the following detailed description, preferred embodiments, and examples, given for the purpose of disclosure, and taken in conjunction with the accompanying drawings and appended claims.

BRIEF DESCRIPTION OF THE DRAWINGS

For a further understanding of the nature and objects of the present inventions, reference should be made to the following detailed disclosure, taken in conjunction with the accompanying drawings, in which like parts are given like reference numerals, and wherein.

DETAILED DESCRIPTION OF EMBODIMENTS OF THE INVENTION

Figure 1:
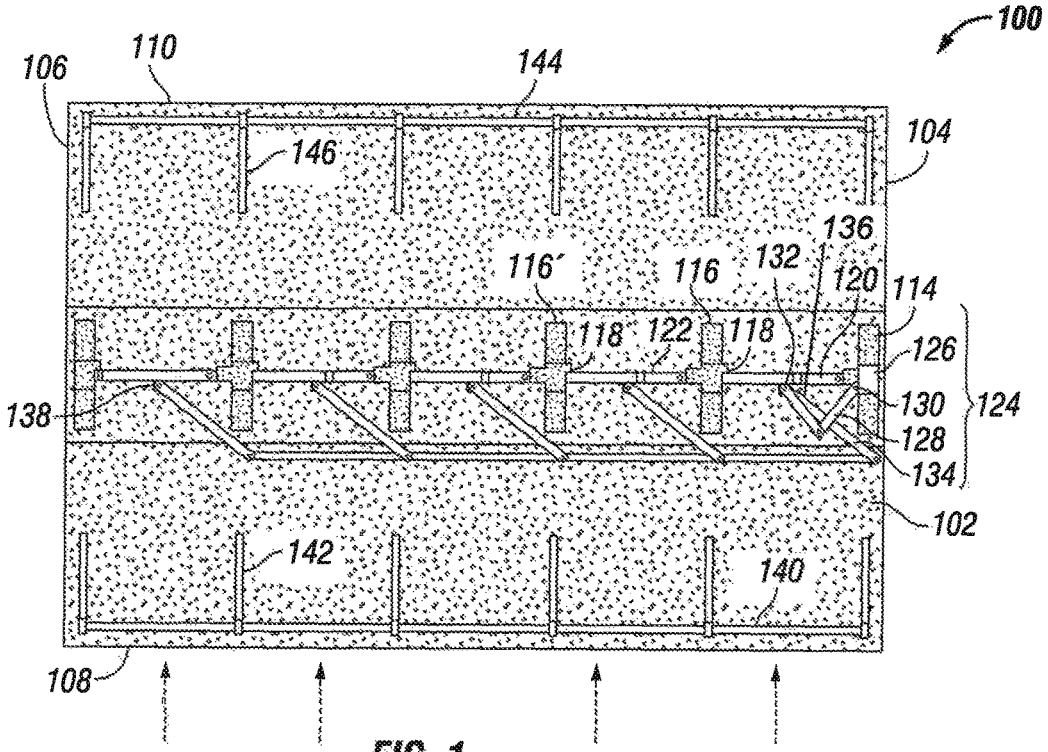
FIG. 1 illustrates a top view of an exemplary open dike equipment and system according to an embodiment of the present invention, showing a flap gate in a closed position at high tide.

The following detailed description of various embodiments of the present invention references the accompanying drawings, which illustrate specific embodiments in which the invention can be practiced. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains. Therefore, the scope of the present invention is defined only by the appended claims, along with the full scope of equivalents to which such claims are entitled.

By exploiting the physical phenomenon of water pressure differential, the inventor has designed an open dike equipment and system that produces a relatively low water pressure differential (i.e., a relatively small difference in water pressure upstream and downstream of the open dike system), and, thus, receives less water flow attack. The open dike equipment and system may be made with a light structure composition, and, thus, it does not require massive material supplies. Further, the open dike equipment and system may be constructed on land, and, thus, it does not require a large amount of construction resources. In addition, the open dike equipment and system is easy to construct and very affordable.

The purpose of the invention is to lower flow velocity of tide from the sea to inland rivers, and, at the same time, lower the tide inflow volume to less than or equal to about 30% or to within a deviation coefficient of about 30% into the river while retaining about 100% outflow volume. In an embodiment, the invention lowers the tide inflow volume about 20% to about 40% (and any range or value there between); and retains about 90% to about 100% outflow volume (and any range or value there between). In an embodiment, the invention lowers the tide inflow to less than or equal to about 40% into the river while maintaining outflow volume at greater than or equal to about 90%. In an embodiment, the invention lowers the tide inflow to less than or equal to about 30% into the river while maintaining outflow volume at greater than or equal to about 95%.

As a result, the rise of water levels on the river is delayed due the reduced flow velocity of tide from the sea to the inland river. The high water levels at numerous locations inland may be postponed, depending on the flow velocity. The delay of high tide may be calculated based on an alert water level and a tide cycle. When reaching the alert water level, the water levels at critical locations would follow the cycle of tide outflow. Thus, the tide would not have an effect of inundation.

Open Dike Equipment and System with Water Pressure Differential

Figure 2:
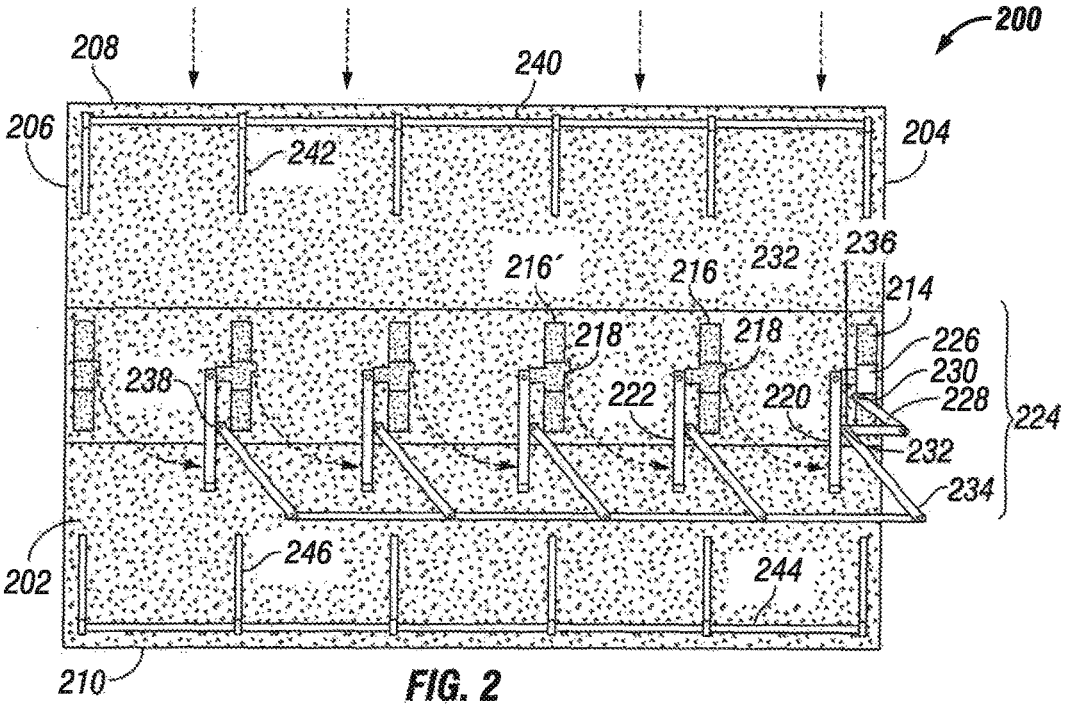
FIG. 2 illustrates a top view of an exemplary open dike equipment and system according to an embodiment of the present invention, showing a flap gate in an open position at low tide.
Figure 3:
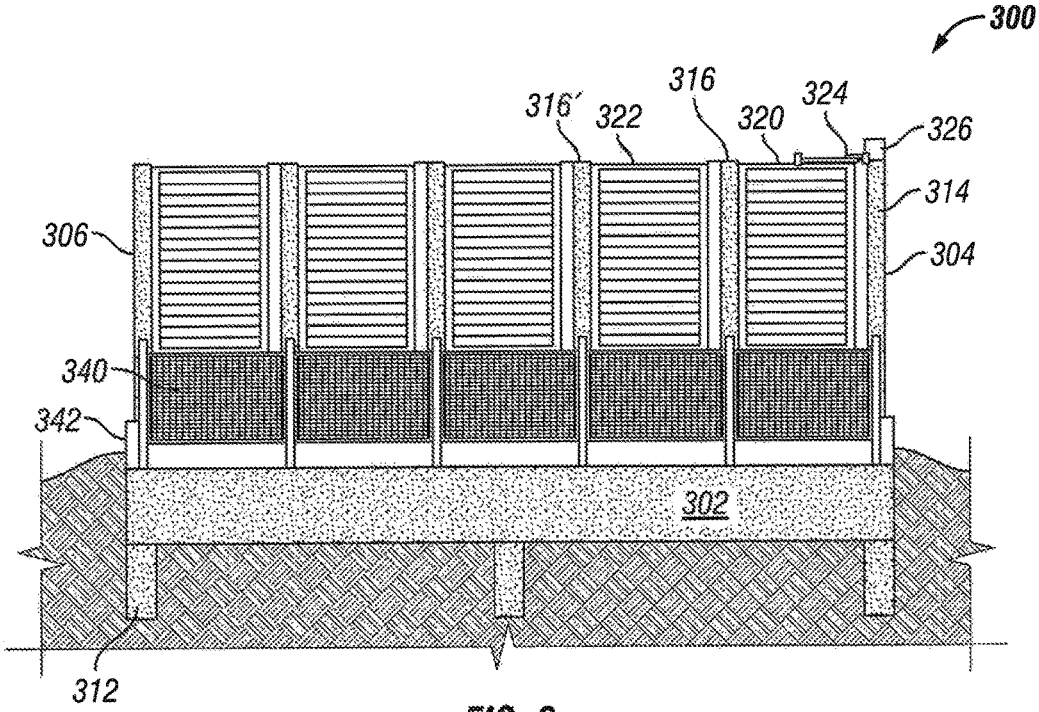
FIG. 3 illustrates a front view of an exemplary open dike equipment and system according to an embodiment of the present invention, showing a flap gate in a closed position and a hollow dike body structure.

A top view of an exemplary open dike equipment and system, showing a flap gate in a closed position at high tide is illustrated in FIG. 1; and a top view of an exemplary open dike equipment and system, showing a flap gate in an open position at low tide is illustrated in FIG. 2. (See also FIGS. 3-7). Referring to FIGS. 1-2, the open dike system 100, 200 comprises a dike body 102, 202 with anchor feet, a first pillar 114, 214, a second pillar 116, 216 and a first flap gate 120, 220 disposed between the first pillar 114, 214 and second pillar 116, 216.

In an embodiment, the open dike system 100, 200 comprises a dike body 102, 202 having a first end 104, 204 and a second end 106, 206 and a first side 108, 208 and a second side 110, 210, a plurality of anchor feet, wherein the plurality of anchor feet may be connected to or integral with a bottom surface of the dike body 102, 202 to anchor the dike body 102, 202 to a river floor; a first pillar 114, 214 connected to or integral with an upper surface along the first end 104, 204 or a first side 108, 208 of the dike body 102, 202, a second pillar 116, 216 connected to or integral with the upper surface of the dike body 102, 202 offset from and approximately parallel to the first pillar 114, 214, a first flap gate 120, 220 rotationally attached to the first pillar 114, 214 and disposed between the first pillar 114, 214 and the second pillar 116, 216, wherein the first flap gate 120, 220 closes against a first extension 118, 218 in the second pillar 116, 216 and a means for opening and closing one or more flap gates 124, 224.

In an embodiment, the open dike system 100, 200 further comprises a third pillar 116', 216' connected to or integral with the upper surface of the dike body 102, 202 offset from and approximately parallel to the second pillar 116, 216; a second flap gate 122, 222 rotationally attached to the second pillar 116, 216 and disposed between the second pillar 116, 216 and the third pillar 116', 216', wherein the second flap gate 122, 222 closes against a second extension 118', 218' in the third pillar 116', 216'.

Dike Body

Figure 4:
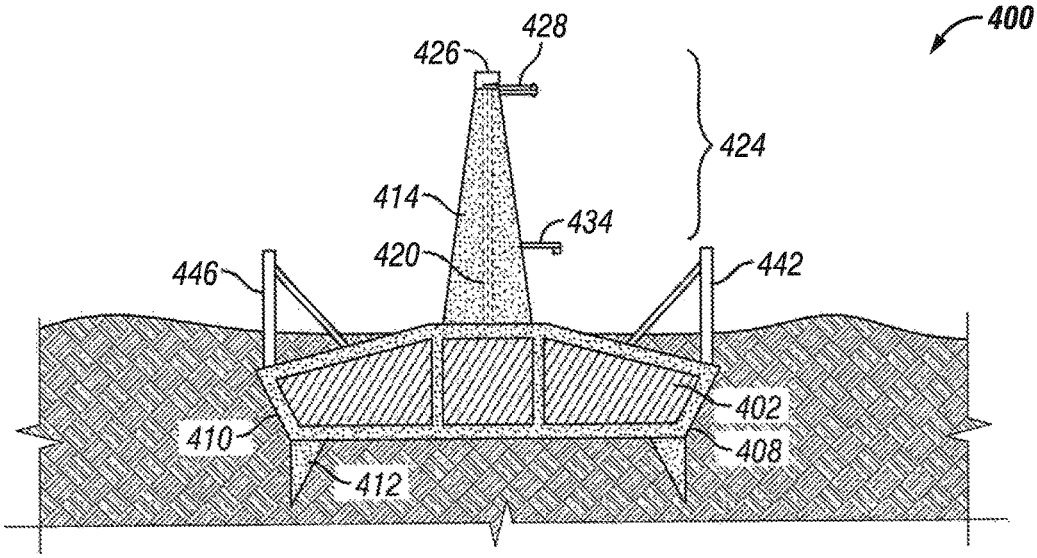
FIG. 4 illustrates a cross-sectional view of an exemplary open dike equipment and system according to an embodiment of the present invention, showing a hollow dike body structure.
Figure 5A:
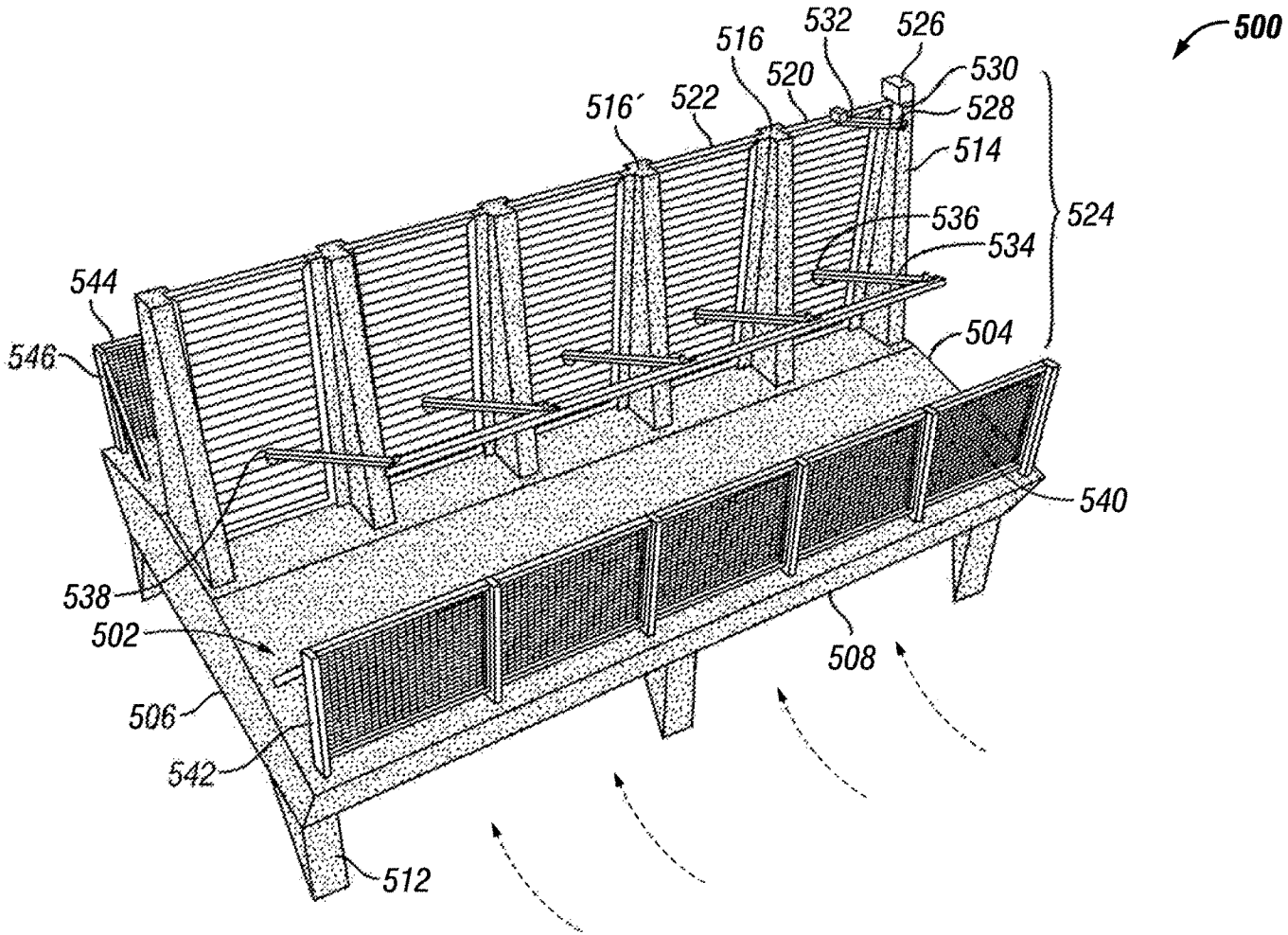
FIG. 5A illustrates a front, upper perspective view of an exemplary open dike equipment and system according to an embodiment of the present invention, showing a flap gate in a closed position at high tide and a hollow dike body structure.
Figure 5B:
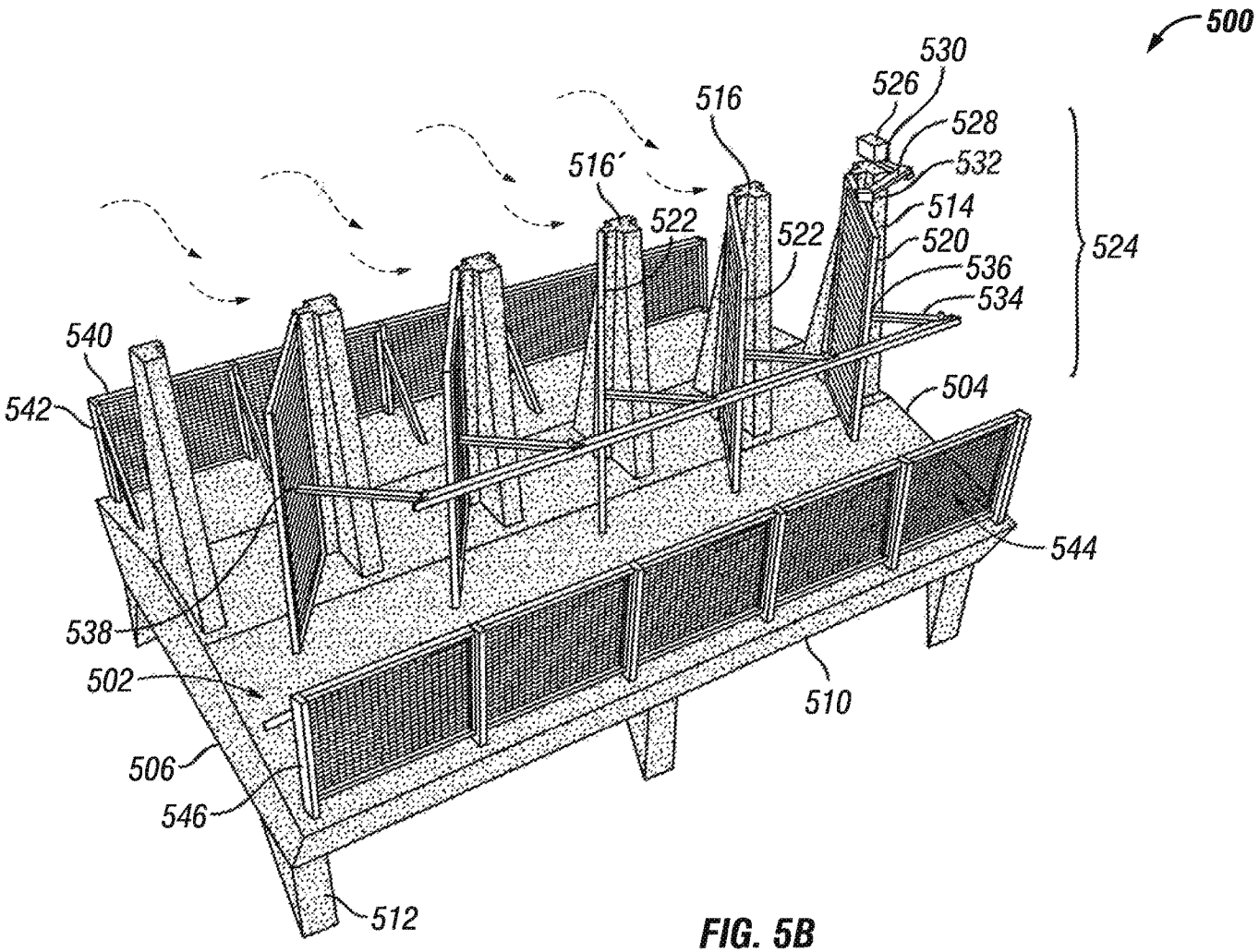
FIG. 5B illustrates a rear, upper perspective view of an exemplary open dike equipment and system according to an embodiment of the present invention, showing a flap gate in an open condition at low tide and a hollow dike body structure.

The dike body 302, 402, 502, 602, 702 may be constructed to be any suitable shape. Suitable shapes include, but are not limited to, cube, cuboid, hexagonal prism, triangular prism and variations thereof. (See e.g., FIGS. 3-7). In an embodiment, the dike body 402, 702 may be a variation of a thick triangular prism shape as depicted in FIGS. 4 and 7. In an embodiment, the dike body 502, 602 may be a variation of a thin triangular prism shape as depicted in FIGS. 5A-5B and 6A-6B. In an embodiment, a water force receiving portion of the dike body may have a profile similar to a flat board, a fan blade, a scoop or a paddle.

Figure 6A:
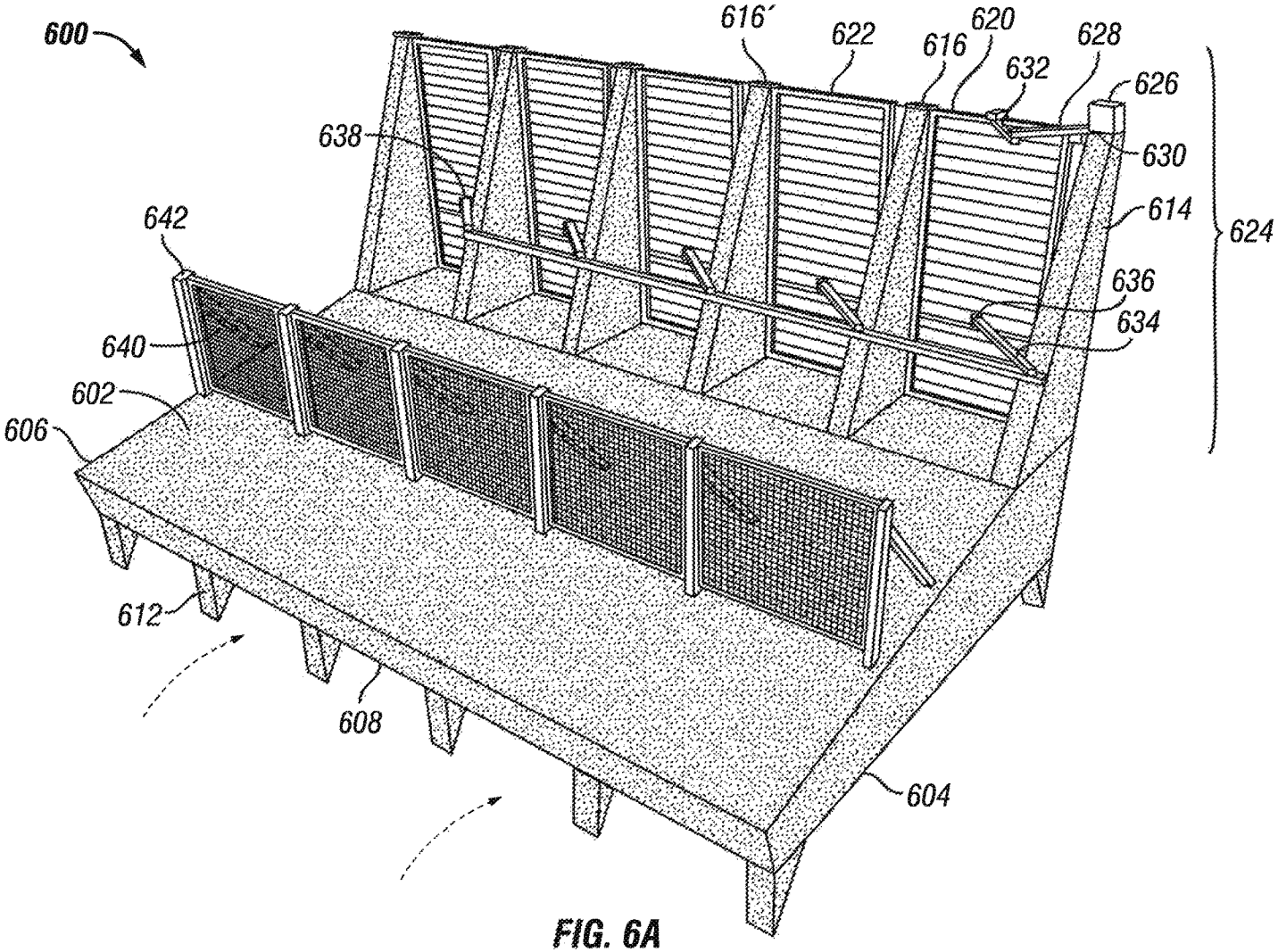
FIG. 6A illustrates a front, right side perspective view of an exemplary open dike equipment and system according to an embodiment of the present invention, showing a flap gate in a closed condition at high tide and a dense dike body structure.
Figure 6B:
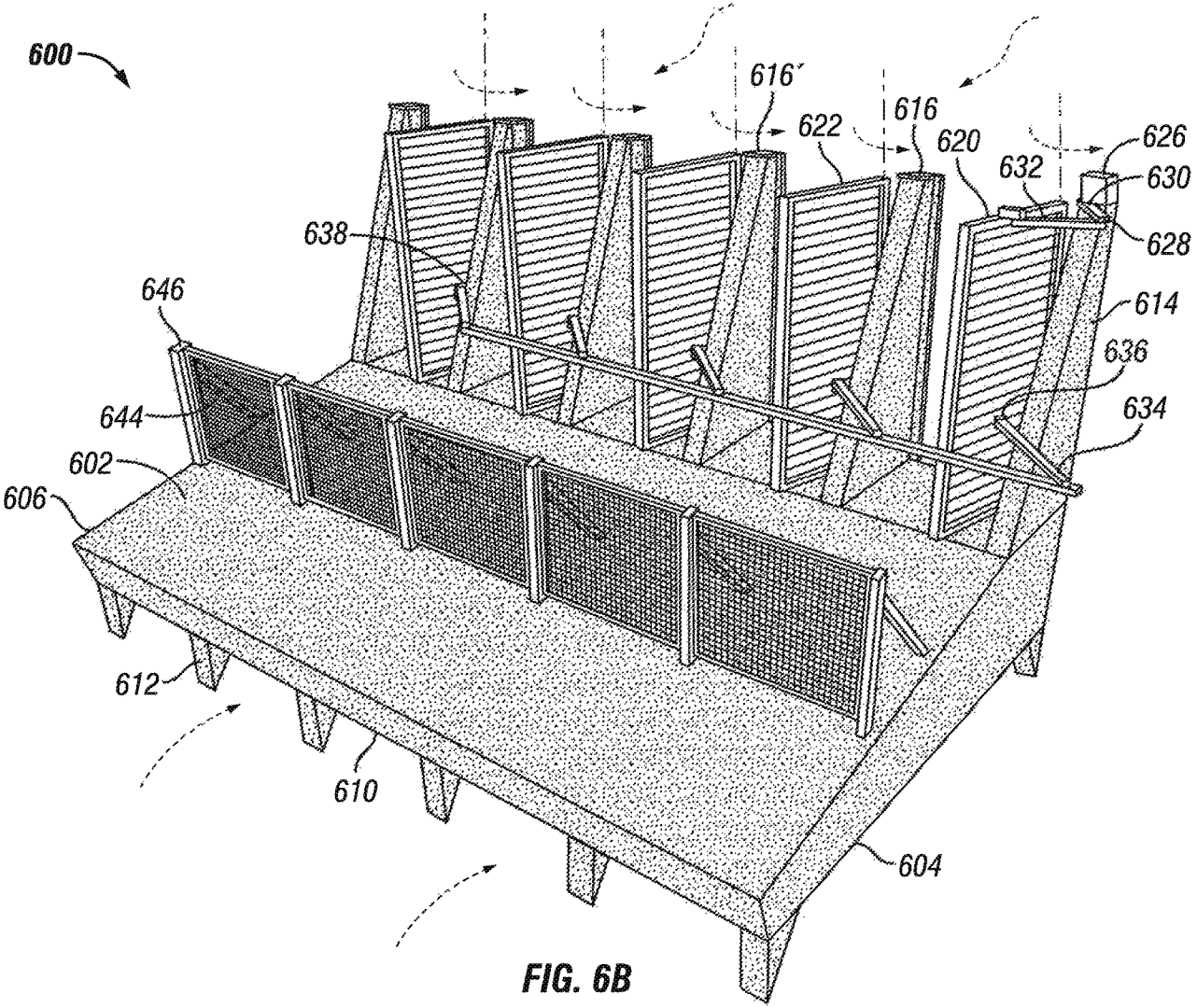
FIG. 6B illustrates a front, right side perspective of an exemplary open dike equipment and system according to an embodiment of the present invention, showing a flap gate in an open condition at low tide and a dense dike body structure.
Figure 7:
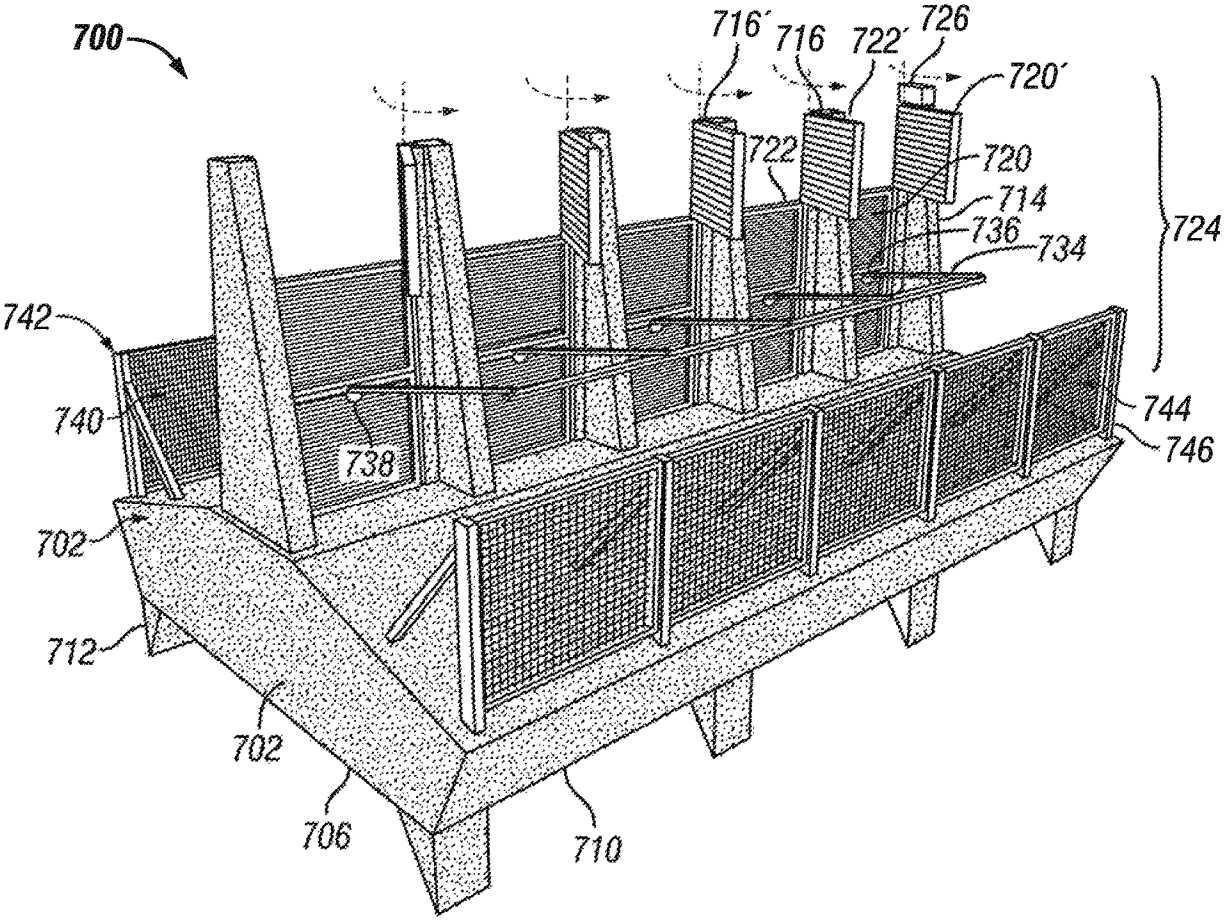
FIG. 7 illustrates a rear, left side perspective view of an exemplary open dike system according to an embodiment of the present invention, showing a flap gate that can lower tide velocity and volume and that can also allow flood discharge from upstream to exit the system and flow downstream.

The dike body 302, 402, 502, 602, 702 may be constructed as a hollow structure (see FIGS. 3-5B), a solid structure (see e.g., FIGS. 6A-7), or a dense solid structure (see FIGS. 6A-7). In an embodiment, the dike body 402 may be a hollow structure. (See FIG. 4). In an embodiment, the dike body 402 may be constructed as a hollow structure that can function like a packet boat, transportable from a manufacturing location to a project site and submerged into a specified position in a river. In an embodiment, the dike body 402 may be constructed as a hollow structure that can be flooded with river water at a specified position in the river.

In an embodiment, the dike body 602, 702 may be a solid structure. (See e.g., FIGS. 6A-7). In an embodiment, the dike body may be constructed as a solid structure that can function like a packet boat, transportable from a manufacturing location to a project site and submerged into a specified position in a river.

In an embodiment, the dike body 602, 702 may be a dense solid structure. (See FIGS. 6A-7). The dense solid structure does not function as a packet boat.

The dike body may be constructed of any suitable material. Suitable materials include, but are not limited to, biological materials (e.g., bamboo and wood), non-biological materials (e.g., composites, concrete, metals and polymers), and combinations thereof. In an embodiment, the dike body may be constructed of composites, concrete, metals, polymers, and combinations thereof.

Anchor Feet

The anchor feet 312, 412, 512, 612, 712 may be constructed to be any suitable shape. Suitable shapes include, but are not limited to, cube, cuboid, cylinder, hexagonal prism, cone, square based pyramid, triangular based pyramid, triangular prism and variations thereof. (See e.g., FIGS. 3-7). In an embodiment, the anchor feet may be a variation of a triangular prism. (See FIGS. 3-7).

In an embodiment, the anchor feet may be retractable or non-retractable.

In an embodiment, the anchor feet may be constructed as a hollow structure, a solid structure or a dense solid structure. In an embodiment, the dike body and the anchor feet may be cast as a single structure (i.e., the anchor feet may be integral with a bottom surface of the dike body). In an embodiment, the dike body and the anchor feet may be separate structures, wherein the anchor feet may be connected to the bottom surface of the dike body.

The anchor feet may be constructed of any suitable material. Suitable materials include, but are not limited to, biological materials (e.g., bamboo and wood), non-biological materials (e.g., composites, concrete, metals and polymers), and combinations thereof. In an embodiment, the anchor feet may be constructed of composites, concrete, metals, polymers, and combinations thereof.

Pillars

The pillars 314, 316, 414, 416, 514, 516, 614, 616, 714, 716 may be constructed to be any suitable shape. Suitable shapes include, but are not limited to, cube, cuboid, hexagonal prism, triangular prism and variations thereof. (See e.g., FIGS. 3-7). In an embodiment, the pillars may be a variation of a triangular prism. (See FIG. 4). In an embodiment, the pillars may be a variation of an upright triangular prism. (See FIGS. 5A-7). In an embodiment, a water force receiving portion of the pillars may have a profile similar to a flat board, a fan blade, a scoop or a paddle.

In an embodiment, the pillars may be constructed to have one or more extensions to attach a flap gate or to provide a sealing surface for an adjacent flap gate. (See e.g., FIGS. 5A-7). The one or more extensions may be constructed to be any suitable shape. Suitable shapes include, but are not limited to, cuboid, hexagonal prism, triangular prism and variations thereof. In an embodiment, the one or more extensions may be a variation of a cuboid. (See FIGS. 5A-7).

In an embodiment, the pillars may be constructed as a hollow structure, a solid structure or a dense solid structure.

In an embodiment, the dike body and the pillars may be cast as a single structure (i.e., the pillars may be integral with an upper surface of the dike body). In an embodiment, the dike body, the anchor feet and the pillars may be cast as a single structure (i.e., the pillars may be integral with an upper surface of the dike body and the anchor feet may be integral with a bottom surface of the dike body).

In an embodiment, the dike body and the pillars may be separate structures, wherein the pillars may be connected to the upper surface of the dike body.

The pillars may be constructed of any suitable material. Suitable materials include, but are not limited to, biological materials (e.g., bamboo and wood), non-biological materials (e.g., composites, concrete, metals and polymers), and combinations thereof. In an embodiment, the pillars may be constructed of composites, concrete, metals, polymers, and combinations thereof.

Flap Gates

The flap gates should have a layout to restrict an aperture of a river to limit the water volume of tide coming upstream; and the flap gates should have a structure to reduce kinetic energy of the water flow to postpone high tide upstream.

The flap gates 320, 322, 520, 522, 620, 622, 720, 722 may be constructed to be any suitable shape. Suitable shapes include, but are not limited to, cuboid, hexagonal prism and variations thereof. (See e.g., FIGS. 3 & 5A-7). In an embodiment, the flap gates may be a variation of a cuboid. (See FIGS. 3 & 5A-7). In an embodiment, a water force receiving portion of the flap gates may have a profile similar to a flat board, a fan blade, a scoop or a paddle.

The flap gates may have any suitable texture. Suitable textures include, but are not limited to, pebbled, slatted, smooth, waffle and combinations thereof. In an embodiment, the flap gates may have a slatted texture.

In an embodiment, the flap gates 320, 322, 520, 522, 620, 622, 720, 722 may be constructed as single structure (see FIGS. 3 & 5A-6B), a two part structure (see FIG. 7) or a multi part structure. As shown in FIG. 7, a lower part of the flap gate 720, 722 opens and closes with an opening/closing means; and an upper part of the flap gate 720', 722' opens and closes with water force, as discussed in detail below.

The flap gates may be constructed of any suitable material. Suitable materials include, but are not limited to, any cavitation resistant material (e.g., vulcanized rubber) and combinations thereof. In an embodiment, the flap gates may be vulcanized rubber.

Means for Opening and Closing One or More Flap Gates

The means for opening and closing one or more flap gates 124, 224 may be any suitable opening/closing system. Suitable opening/closing systems include, but are not limited to, rotors with one or more flexible arm structures to open one or more flap gates. In an embodiment, the means for opening and closing one or more flap gates 124, 224 or opening/closing system comprises a flap gate rotor 126, 226 attached to the first pillar 114, 214, and a flexible arm structure 128, 228 having a first end 130, 230 and a second end 132, 232, wherein the first end 130, 230 of the flexible arm structure 128, 228 is flexibly attached to the flap gate rotor 126, 226 and the second end 132, 232 of the flexible arm structure 128, 228 is flexibly attached to the first flap gate 120, 220. In an embodiment, the flexible arm structure 128, 228 may have one or more hinges between the first end 130, 230 and the second end 132, 232.

In another embodiment, the means for opening and closing one or more flap gates 124, 224 or opening/closing system comprises a flap gate rotor 126, 226 attached to the first pillar 114, 214, a first flexible arm structure 128, 228 having a first end 130, 230 and a second end 132, 232, wherein the first end 130, 230 of the first flexible arm structure 128, 228 is flexibly attached to the flap gate rotor 126, 226 and the second end 132, 232 of the first flexible arm structure 128, 228 is flexibly attached to the first flap gate 120, 220, and a second flexible arm structure 134, 234 having a first end 136, 236 and a second end 138, 238, wherein the first end 136, 236 of the second flexible arm structure 134, 234 is flexibly attached to the first flap gate 120, 220 and the second end 138, 238 of the second flexible arm structure 134, 234 is flexibly attached to the second flap gate 122, 222. In an embodiment, the first flexible arm structure 128, 228 may have one or more hinges between the first end 130, 230 and the second end 132, 232; and the second flexible arm structure 134, 234 may have one or more hinges between the first end 136, 236 and the second end 138, 238.

In an embodiment, the flap gate rotor 126, 226 may be controlled by electricity, hydraulics, water force, and combinations thereof. Such control is well known in the art.

Trash Nets

In an embodiment, the open dike system 100, 200 further comprises a first trash net 140, 240 and a first structural frame 142, 242, wherein the first trash net 140, 240 is attached to the first structural frame 142, 242 and the first structural frame 142, 242 is attached to an upper surface along the first side 108, 208 of the dike body 102, 202 to prevent large trash from entering one or more flap gates. However, the first trash net 140, 240 does not prevent sediment contained within the water flow from entering the one or more flap gates.

In an embodiment, the open dike system 100, 200 further comprises a second trash net 144, 244 and a second structural frame 146, 246, wherein the second trash net 144, 244 is attached to the second structural frame 146, 246 and the second structural frame 146, 246 is attached to an upper surface along the second side 110, 210 of the dike body 102, 202 to prevent large trash from entering one or more flap gates. However, the second trash net 144, 244 does not prevent sediment contained within the water flow from entering the one or more flap gates.

In an embodiment, the first structural frame may be offset from an edge of the first side of the dike body and the second structural frame is offset from an edge of the second side of the dike body to both be positioned more closely to the one or more flap gates. (See e.g., FIGS. 5A-7).

Layouts of Open Dike Equipment and System

For areas with a semi diurnal tide, which on average takes greater than or equal to about six hours for tide from the sea to reach from low to high tide then recedes, the open dike system of the present invention may leave a navigable channel L unobstructed. (See FIGS. 8A-9B, 16, 19A-20 & 22A-22C). The receding of high tide generally follows a graph of W or M, depending on astronomical and hydrological cycles which influence high and low tide.

For areas with diurnal tide, which on average takes greater than or equal to about twelve hours for tide from the sea to reach from low to high tide then recedes, the open dike system of the present invention further comprises a flap gate installed across a navigable channel L in one or more open dike system row. (See FIGS. 14: 1415 & 23A-23C). In an embodiment, the one or more flap gates may be closed at high tide and opened at low tide.

The open dike system may be arranged in any suitable layout for the local topography and regional tide conditions. Suitable layouts include, but are not limited to, dual sided chevrons or rows, single sided chevrons or rows (e.g., opposite side is cliff, foothill, infrastructure or river bottom topography that cannot be altered) and combinations thereof. In an embodiment, the layout of the plurality of open dike systems is selected from the group consisting of dual sided, asymmetric chevrons, dual sided asymmetric rows, dual sided symmetric chevrons, dual sided symmetric rows, single sided rows, single sided chevrons and combinations thereof.

Figure 8A:
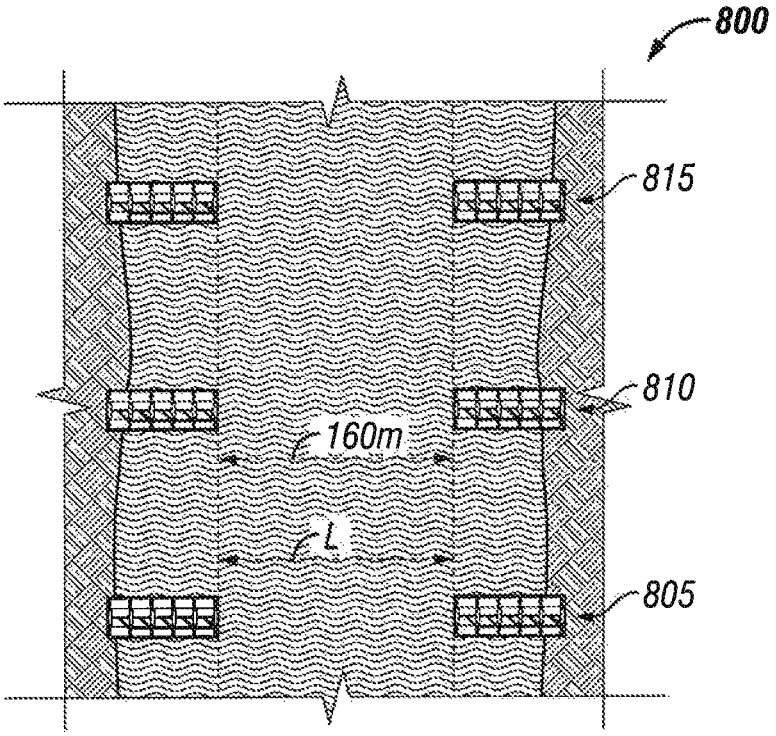
FIG. 8A illustrates a top view of an exemplary layout of a plurality of open dike systems positioned along a river in dual sided, symmetric rows according to an embodiment of the present invention.

FIGS. 8A-8D illustrate top views of exemplary layouts of a plurality of open dike systems. FIG. 8A illustrates a top view of an exemplary layout of a plurality of open dike systems positioned along a river in dual sided, symmetric rows. As shown in FIG. 8A, the layout 800 comprises a first open dike system row 805, a second open dike system row 810 and an optional third open dike system row 815. The first 805, second 810 and optional third open dike system rows 815 may be positioned along the river in dual sided, symmetric rows, leaving a navigation channel L unobstructed. As shown in FIG. 8, the navigable channel L can be controlled based on the layout of the plurality of open dike systems, as the system does not depend on an open or a closed condition of a flap gate, water vehicles can freely move freely within the navigable channel L. In an embodiment, the navigable channel L may be about 160 meters.

At low tide, a flap gate may be opened to allow discharge water to flow freely downstream. During a rainy season, the flap gate will only be closed for a few to several hours during high tide of the day. However, during a dry season, the flap gate may only be closed for a short period of time or not at all.

Figure 8B:
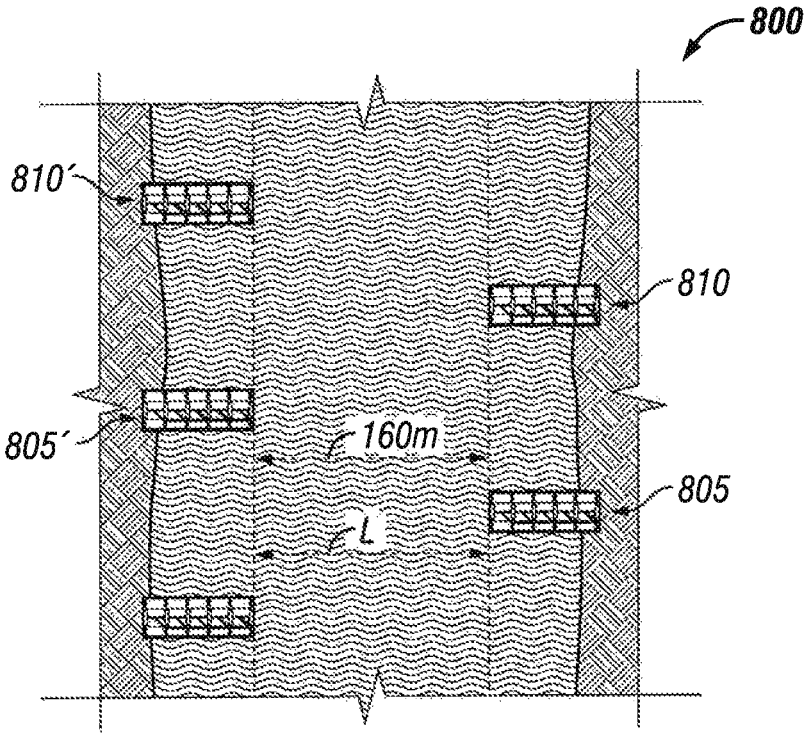
FIG. 8B illustrates a top view of an exemplary layout of a plurality of open dike systems positioned along a river in dual sided, asymmetric rows according to an embodiment of the present invention.

FIG. 8B illustrates a top view of an exemplary layout of a plurality of open dike systems positioned along a river in dual sided, asymmetric rows. As shown in FIG. 8B, the layout 800 comprises a first open dike system 805, a second open dike system 810, a third open dike system 805', and a fourth open dike system 810'. The first 805, second 810, third 805' and fourth open dike systems 810' may be positioned along the river in dual sided, asymmetric rows, leaving a navigable channel L unobstructed. In other words, the first 805 and second open dike systems 810 may be positioned opposite of and offset from the third 805' and fourth open dike systems 810'. In an embodiment, the navigable channel L may be about 160 meters.

Figure 8C:
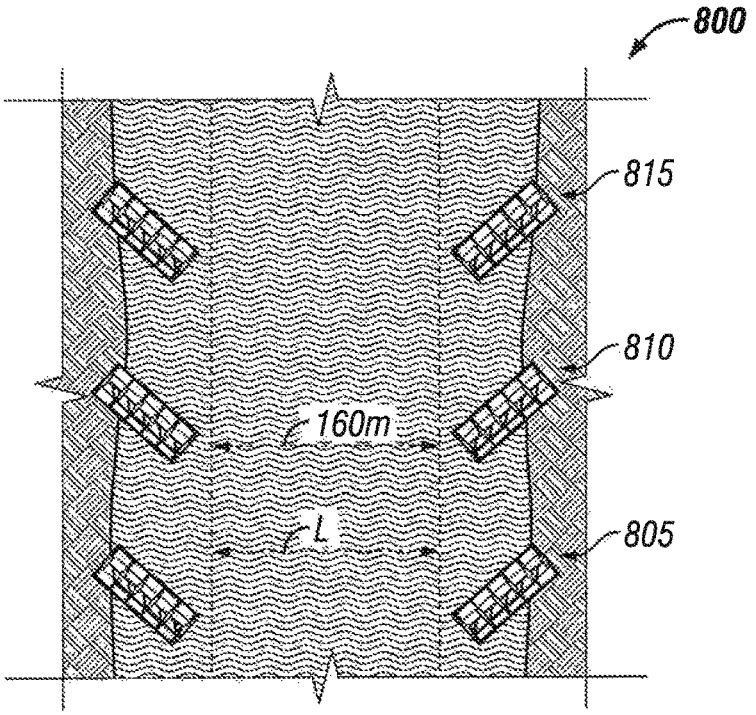
FIG. 8C illustrates a top view of an exemplary layout of a plurality of open dike systems positioned on a river in dual sided, symmetric chevrons according to an embodiment of the present invention.

FIG. 8C illustrates a top view of an exemplary layout of a plurality of open dike systems positioned on a river in dual sided, symmetric chevrons. As shown in FIG. 8C, the layout 800 comprises a first open dike system chevron 805, a second open dike system chevron 810 and an optional third open dike system chevron 815. The first 805, second 810 and optional third open dike system chevrons 815 may be positioned along the river in dual sided, symmetric chevrons, leaving a navigable channel L unobstructed. In an embodiment, the navigable channel L may be about 160 meters.

Figure 8D:
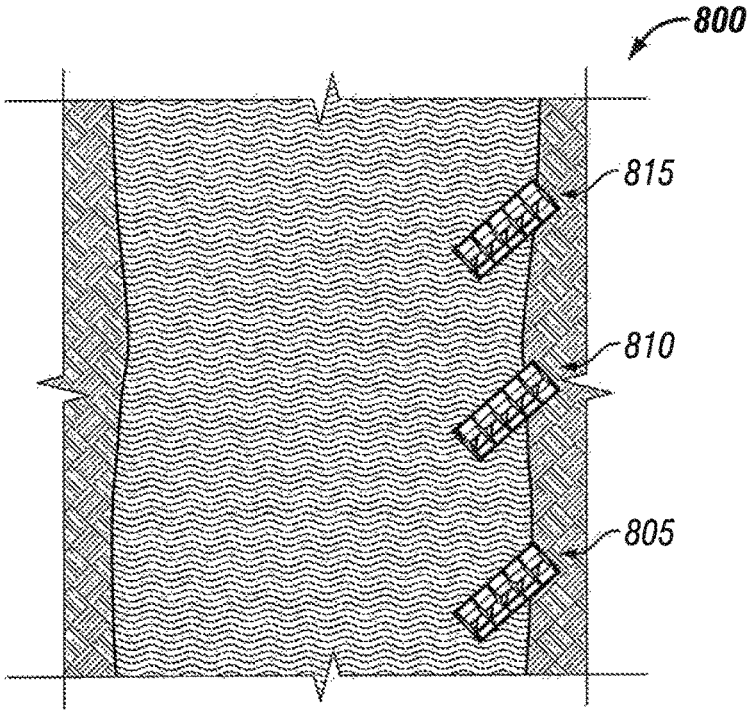
FIG. 8D illustrates a top view of an exemplary layout of a plurality of open dike systems positioned on a river in single sided chevron according to an embodiment of the present invention.

FIG. 8D illustrates a top view of an exemplary layout of a plurality of open dike systems 800 positioned on a river in a single sided chevron. As shown in FIG. 8D, the layout 800 comprises a first open dike system chevron 805, a second open dike system chevron 810 and an optional third open dike system chevron 815. The first 805, second 810 and optional third open dike system chevrons 815 may be positioned along the river in single sided, symmetric chevrons.

Figure 9A:
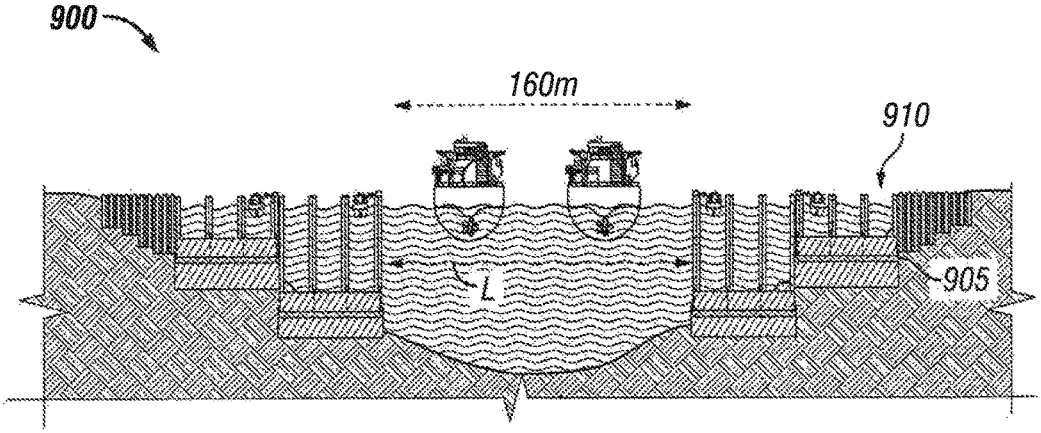
FIG. 9A illustrates a cross-sectional view of an exemplary layout of a plurality of open dike systems positioned along a river in dual sided, symmetric rows according to an embodiment of the present invention, showing one or more flap gates in an open condition at low tide to allow small boats to travel along the river.
Figure 9B:
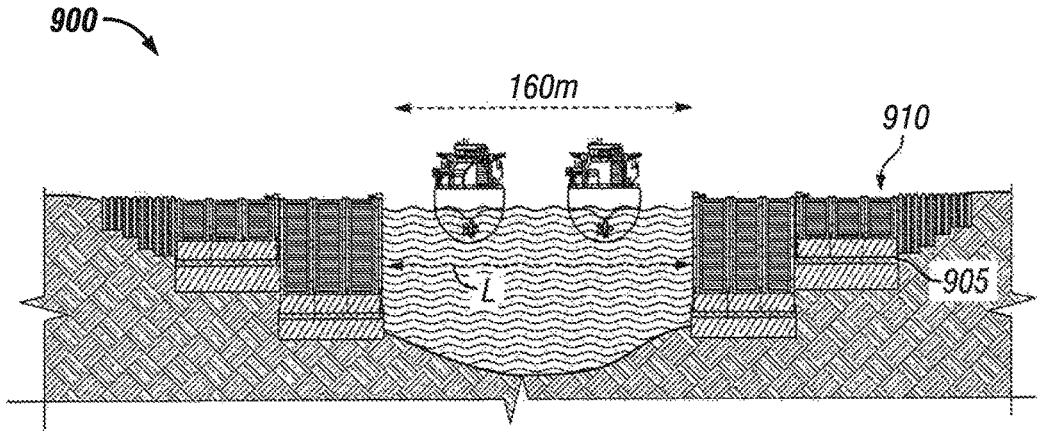
FIG. 9B illustrates a cross-sectional view of the exemplary layout of FIG. 9A, showing the one or more flap gates in a closed condition at high tide.

FIGS. 9A-9B illustrate a cross-sectional view of an exemplary open dike system, showing operation of one or more flap gates. FIG. 9A illustrates a cross-sectional view of an exemplary layout of a plurality of open dike systems positioned along a river in dual sided, symmetrical rows, showing one or more flap gates 910 in an open condition at low tide to allow small boats to travel along the river. As shown in FIG. 9A, the layout 900 comprises a first open dike system row 905. The first row 905 is positioned on the river in a dual sided, symmetrical row, leaving a navigable channel L unobstructed. In an embodiment, the navigable channel L may be about 160 meters.

FIG. 9B illustrates a cross-sectional view of the exemplary layout of FIG. 9A, showing the one or more flap gates 910 in a closed condition at high tide.

Figure 10:
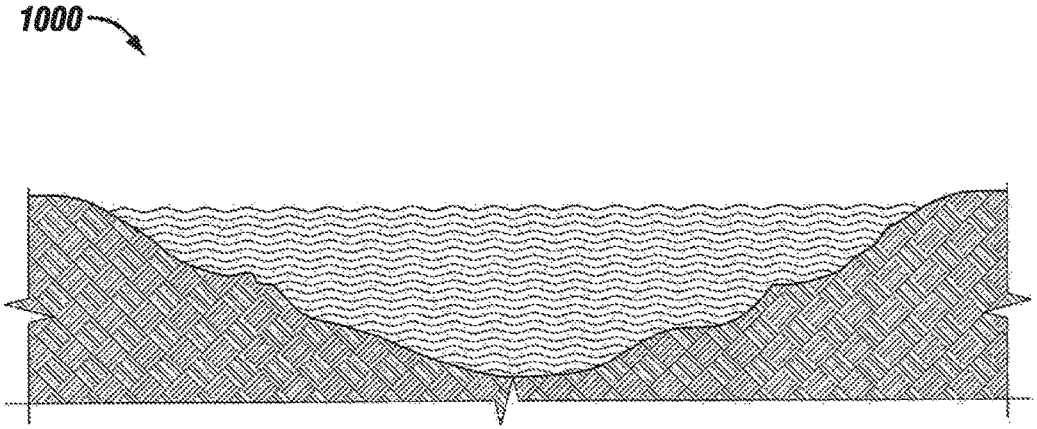
FIG. 10 illustrates a cross-sectional view of a river at its original state with a wide aperture, wherein the river's volumetric flow is not obstructed or reduced.
Figure 11:
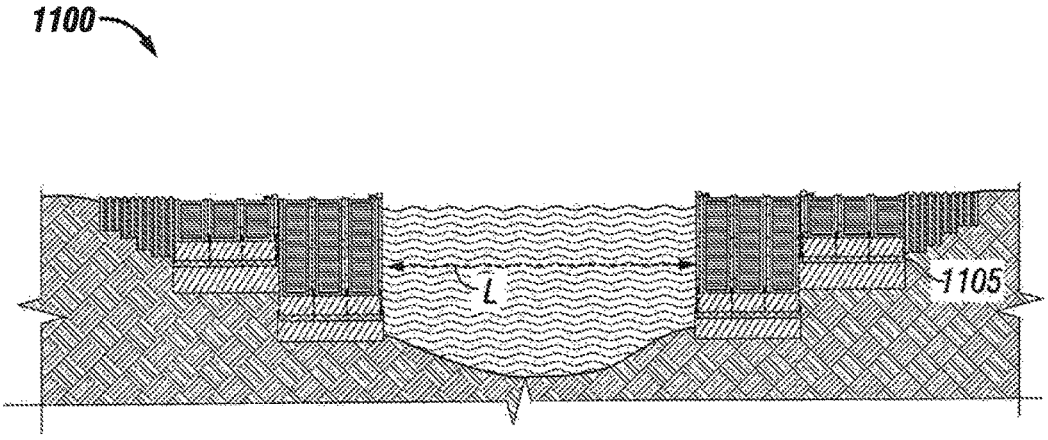
FIG. 11 illustrates a cross-sectional view of an exemplary layout of a plurality of open dike systems positioned on the river of FIG. 10 in dual sided, symmetric rows according to an embodiment of the present invention, wherein the river's natural volumetric flow is restricted and reduced.

Referring to FIGS. 10-11 and 22A-23C, the operation of the open dike system is described to fully elaborate the nature of the present invention and the differences between this invention and existing solutions. FIG. 10 illustrates a cross-sectional view of a river 1000 at its original state with a wide aperture, wherein the river volumetric flow is not obstructed; and FIG. 11 illustrates a cross-sectional view of an exemplary layout of a plurality of open dike systems positioned on the river of FIG. 10 in dual sided, symmetrical rows, wherein the natural river volumetric flow is restricted and reduced upstream of the system. As a result, a tide volumetric flow after flowing through the open dike system is reduced compared to the volumetric flow when the system is not installed. Further, the tide water level upstream of the open dike system will be lower than the water level downstream of the open dike system.

As shown in FIG. 11, the layout 1100 comprises a first open dike system row 1105. The first row 1105 is positioned on the river in a dual sided, symmetrical row, leaving a navigable channel L unobstructed.

Existing Breakwater Systems

Figure 12:
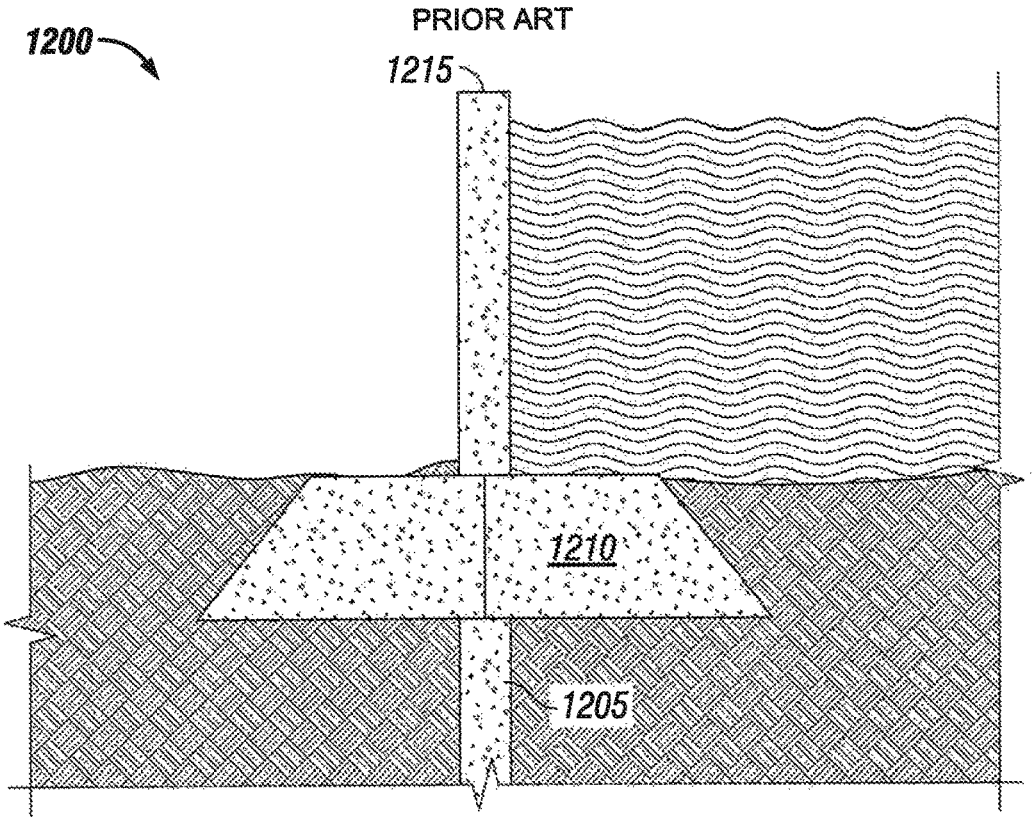
FIG. 12 illustrates a cross-sectional view of a typical solid breakwater.
Figure 13:
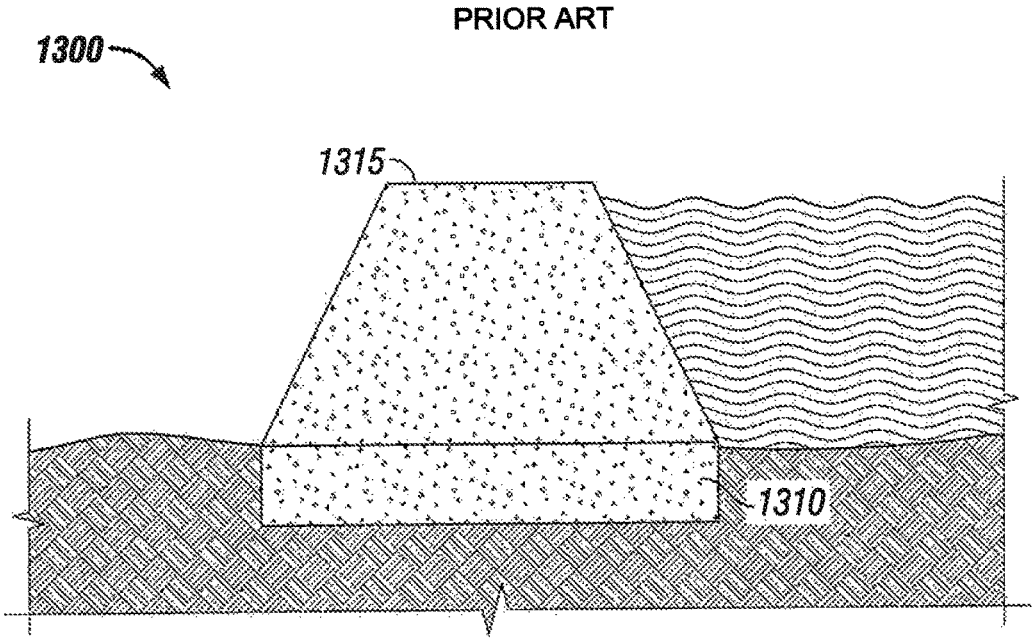
FIG. 13 illustrates a cross-sectional view of an existing solidified breakwater.

FIGS. 12-13 illustrate existing breakwater systems to block tide or water flow.

FIG. 12 illustrates a cross-sectional view of a typical solid breakwater. As shown in FIG. 12, the typical solid breakwater system 1200 comprises a foundation pillar 1205, a base section 1210 and a wall 1215. The foundation pillar 1205 is installed with the base section 1210 so that: 1) the weight of the base section 1210 is greater than the horizontal force of water so that the system 1200 does not migrate (however, the weight should not cause the system 1200 to sink freely in the river bottom), and 2) the surface area of the submerged base section 1210—when contacting with the pressure of the river floor—is greater than the horizontal force of water on the wall 1215 so that the system 1200 does not collapse.

FIG. 13 illustrates a cross-sectional view of a solidified breakwater system. As shown in FIG. 13, the solidified breakwater system 1300 comprises a base section 1310 and a wall section 1315. The solidified breakwater system 1300 has sufficient mass to withstand the horizontal force of water and sufficient surface area to prevent the solidified breakwater system 1300 from sinking into the river bottom.

Figure 14:
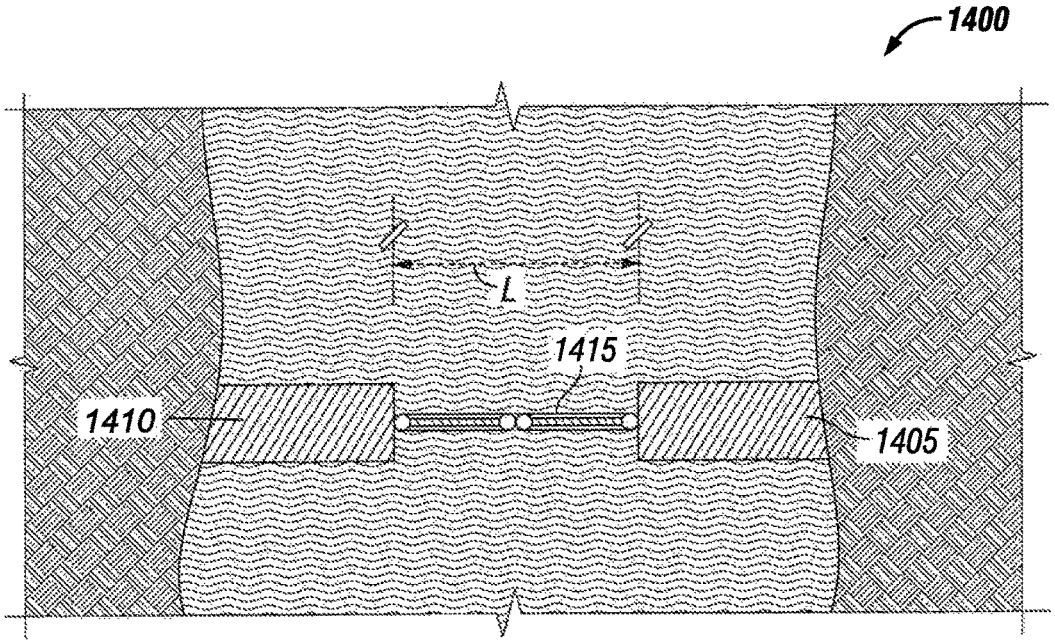
FIG. 14 illustrates a top view of a layout of a flap gate installed across an existing solidified breakwater system.

FIG. 14 illustrates a top view of a layout of a flap gate installed across an existing solidified breakwater system. As shown in FIG. 14, the solidified breakwater system 1400 comprises a first solidified breakwater 1405, a second solidified breakwater 1410 and a flap gate 1415, wherein the flap gate 1415 is disposed between the first solidified breakwater 1405 and the second solidified breakwater 1410. The flap gate 1415 allows boats to travel along the river and upstream water to discharge to the sea.

Open Dike Systems as a Breakwater Solution

Figure 15:
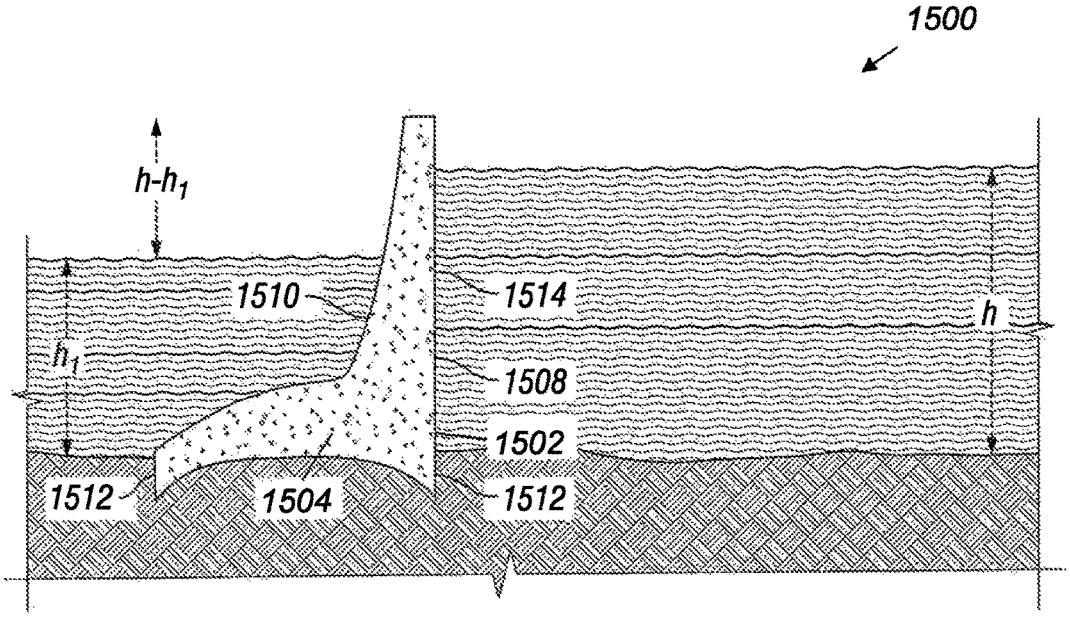
FIG. 15 illustrates a cross-sectional view of an exemplary open dike system positioned on a river according to an embodiment of the present invention, showing a difference ($h-h_1$) in the river water levels due to the open dike system.

The open dike equipment and system may be used as a breakwater solution. FIG. 15 illustrates a cross-sectional view of an exemplary open dike equipment and system positioned on a river, showing a difference in the river's water levels due to the open dike system. As shown in FIG. 15, the open dike system 1500 comprises a base section 1502 (i.e., dike body) with anchor feet 1512 and a wall section 1514 (i.e., pillar).

In an embodiment, the open dike system 1500 comprises a base section 1502 having a first end 1504 and a second end, and a first side 1508 and a second side 1510; a plurality of anchor feet 1512, wherein the plurality of anchor feet 1512 may be connected to or integral with a bottom surface of the base section 1502; and a wall section 1514 connected to or integral with an upper surface along the first side of the base section 1502.

Base Section

The base section 1502 may be constructed to be any suitable shape. Suitable shapes include, but are not limited to, cube, cuboid, hexagonal prism, triangular prism and variations thereof. (See e.g., FIGS. 15 & 17-18). In an embodiment, the base section 1502 may be a variation of a rounded triangular prism shape as depicted in FIGS. 15 and 17-18. In an embodiment, a water force receiving portion of the base section may have a profile similar to a flat board, a fan blade, a scoop or a paddle.

The base section 1502 may be constructed as a hollow structure, a solid structure (see e.g., FIG. 17) or a dense solid structure (see e.g., FIGS. 15 & 18). In an embodiment, the base section may be constructed as a hollow structure that can function like a packet boat, transportable from a manufacturing location to a project site and submerged into a specified position in a river. In an embodiment, the base section may be constructed as a hollow structure that can be flooded with river water at the specified position in a river.

In an embodiment, the base section 1502 may be a solid structure. (See e.g., FIG. 17). In an embodiment, the base section may be constructed as a hollow structure that can function like a packet boat, transportable from a manufacturing location to a project site and submerged into a specified position in a river.

In an embodiment, the base section 1502 may be a dense solid structure. (See FIGS. 15 & 18). The dense solid structure does not function as a packet boat.

The base section may be constructed of any suitable material. Suitable materials include, but are not limited to, biological materials (e.g., bamboo and wood), non-biological materials (e.g., composites, concrete, metals and polymers), and combinations thereof. In an embodiment, the base section may be constructed of composites, concrete, metals, polymers, and combinations thereof.

Anchor Feet

The anchor feet 1512 may be constructed to be any suitable shape. Suitable shapes include, but are not limited to, cube, cuboid, cylinder, hexagonal prism, cone, square based pyramid, triangular based pyramid, triangular prism and variations thereof. (See e.g., FIGS. 15 & 17A-18). In an embodiment, the anchor feet may be a variation of a triangular prism. (See FIGS. 15 & 17A-18).

In an embodiment, the anchor feet may be retractable or non-retractable.

In an embodiment, the anchor feet may be constructed as a solid structure or a dense solid structure. In an embodiment, the base section and the anchor feet may be cast as a single structure (i.e., the anchor feet may be integral with a bottom surface of the base section). In an embodiment, the dike body and the anchor feet may be separate structures, wherein the anchor feet may be connected to the bottom surface of the base section.

The anchor feet may be constructed of any suitable material. Suitable materials include, but are not limited to, biological materials (e.g., bamboo and wood), non-biological materials (e.g., composites, concrete, metals and polymers), and combinations thereof. In an embodiment, the anchor feet may be constructed of composites, concrete, metals, polymers, and combinations thereof.

Wall Section

The wall section 1514 may be constructed to be any suitable shape. Suitable shapes include, but are not limited to, cube, cuboid, hexagonal prism, triangular prism and variations thereof. (See e.g., FIGS. 15 & 17A-18). In an embodiment, the wall section 1514 may be a variation of an upright triangular prism. (See FIGS. 15 & 17A-18). In an embodiment, a water force receiving portion of the wall section may have a profile similar to a flat board, a fan blade, a scoop or a paddle.

In an embodiment, the wall section 1514 may be constructed to have one or more extensions to attach a flap net or to provide a sealing surface for an adjacent flap net. (See e.g., FIGS. 14: 1415 & 23A-23C). The one or more extensions may be constructed to be any suitable shape. Suitable shapes include, but are not limited to, cuboid, hexagonal prism, triangular prism and variations thereof. In an embodiment, the one or more extensions may be a variation of a cuboid. (See e.g., FIGS. 5A-7 & 16).

In an embodiment, the wall section may be constructed as a hollow structure, a solid structure or a dense solid structure.

In an embodiment, the base section and the wall section may be cast as a single structure (i.e., the wall section may be integral with an upper surface of the base section). In an embodiment, the base section with the anchor feet and the wall section may be cast as a single structure (i.e., the wall section may be integral with an upper surface of the base section and the anchor feet may be integral with a bottom surface of the base section).

In an embodiment, the base section and the wall section may be separate structures, wherein the wall section may be connected to the upper surface of the base section.

The wall section may be constructed of any suitable material. Suitable materials include, but are not limited to, biological materials (e.g., bamboo and wood), non-biological materials (e.g., composites, concrete, metals and polymers), and combinations thereof. In an embodiment, the wall section may be constructed of composites, concrete, metals, polymers, and combinations thereof.

Flap Gates

The flap gates 1630 should have a layout to restrict an aperture of a river to limit the water volume of tide coming upstream; and the flap gates should have a structure and/or texture to reduce kinetic energy of the water flow to postpone high tide upstream. (See e.g., FIGS. 3, 5A-7 & 16).

The flap gates 1630 may be constructed to be any suitable shape. Suitable shapes include, but are not limited to, cuboid, hexagonal prism and variations thereof. (See e.g., FIGS. 3, 5A-7 & 16). In an embodiment, the flap gates may be a variation of a cuboid. (Id.). In an embodiment, a water force receiving portion of the flap gates may have a profile similar to a flat board, a fan blade, a scoop or a paddle.

In an embodiment, the flap gates 1630 may be constructed as a single structure (see e.g., FIGS. 3, 5A-6B & 16), a two part structure (see e.g., FIG. 7) or a multi-part structure.

The flap gates may be constructed of any suitable material. Suitable materials include, but are not limited to, any cavitation resistant material (e.g., vulcanized rubber) and combinations thereof. In an embodiment, the flap gates may be vulcanized rubber.

Means for Opening and Closing One or More Flap Gates

As discussed above with respect to the open dike equipment and system, the means for opening and closing one or more flap gates may be any suitable opening/closing system. Suitable opening/closing systems include, but are not limited to, rotors with one or more flexible arm structures to open one or more flap gates.

Layouts of Open Dike Equipment and System as a Breakwater Solution

For areas with a semi diurnal tide, which on average takes greater than or equal to about six hours for tide from the sea to reach from low to high tide then recedes, the open dike system of the present invention may leave a navigable channel L unobstructed. (See FIGS. 8A-9B, 16, 19A-20 & 22A-22C). The receding of high tide generally follows a graph of W or M, depending on astronomical and hydrological cycles which influence high and low tide.

For areas with diurnal tide, which on average takes greater than or equal to about twelve hours for tide from the sea to reach from low to high tide then recedes, the open dike system of the present invention further comprises a flap gate installed across a navigable channel L in one or more open dike system row. (See FIGS. 14: 1415 & 23A-23C). In an embodiment, the one or more flap gates may be closed at high tide and opened at low tide.

The open dike system may be arranged in any suitable layout for the local topography and regional tide conditions. Suitable layouts include, but are not limited to, dual sided chevrons or rows, single sided chevrons or rows (e.g., opposite side is cliff, foothill, infrastructure or river bottom topography that cannot be altered) and combinations thereof. In an embodiment, the layout of the plurality of open dike systems is selected from the group consisting of dual sided, asymmetric chevrons, dual sided asymmetric rows, dual sided symmetric chevrons, dual sided symmetric rows, single sided rows, single sided chevrons and combinations thereof.

Figure 19A:
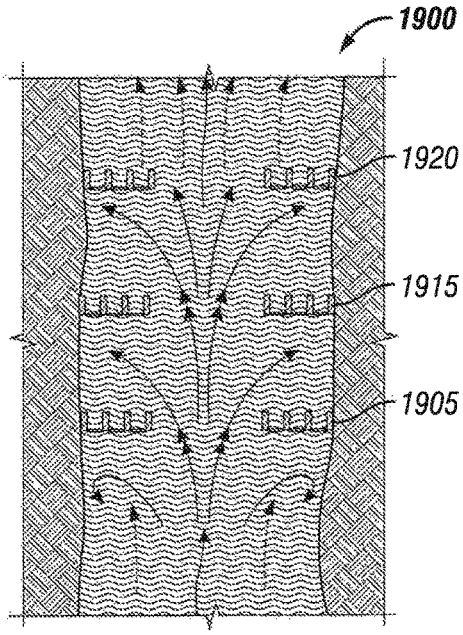
FIG. 19A illustrates a top view of an exemplary "scheme 1" layout of a plurality of open dike systems positioned along a river in dual sided, symmetric rows according to an embodiment of the present invention, showing illustrative water flow patterns due to the perpendicular, symmetric layout.
Figure 19B:
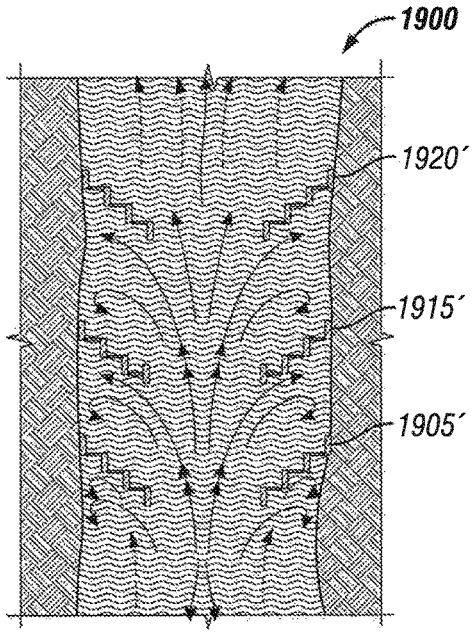
FIG. 19B illustrates a top view of an exemplary "scheme 2" layout of a plurality of open dike systems positioned along a river in dual sided, symmetric chevrons according to an embodiment of the present invention, showing illustrative water flow patterns due to the angled, symmetric layout.

In an embodiment, the chevrons or rows may be asymmetric (see e.g., FIGS. 19C-19D) or symmetric (see e.g., FIGS. 19A-19B).

Figure 19C:
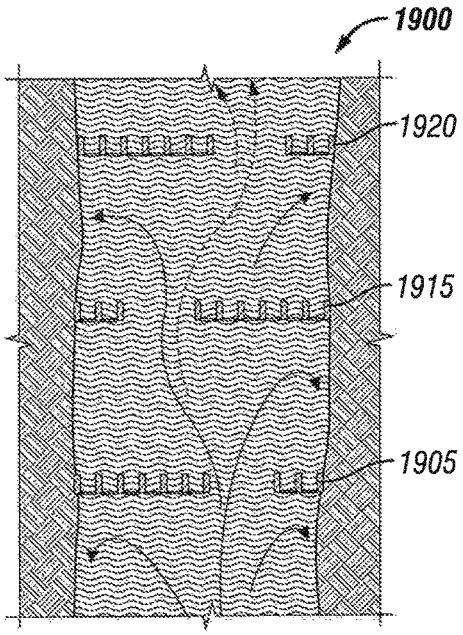
FIG. 19C illustrates a top view of an exemplary "scheme 3" layout of a plurality of open dike systems positioned along a river in dual sided, asymmetric rows according to an embodiment of the present invention, showing illustrative water flow patterns due to the layout.

In an embodiment, the chevrons or rows may be non-parallel or parallel (see e.g., FIGS. 19A & 19C).

Figure 16:
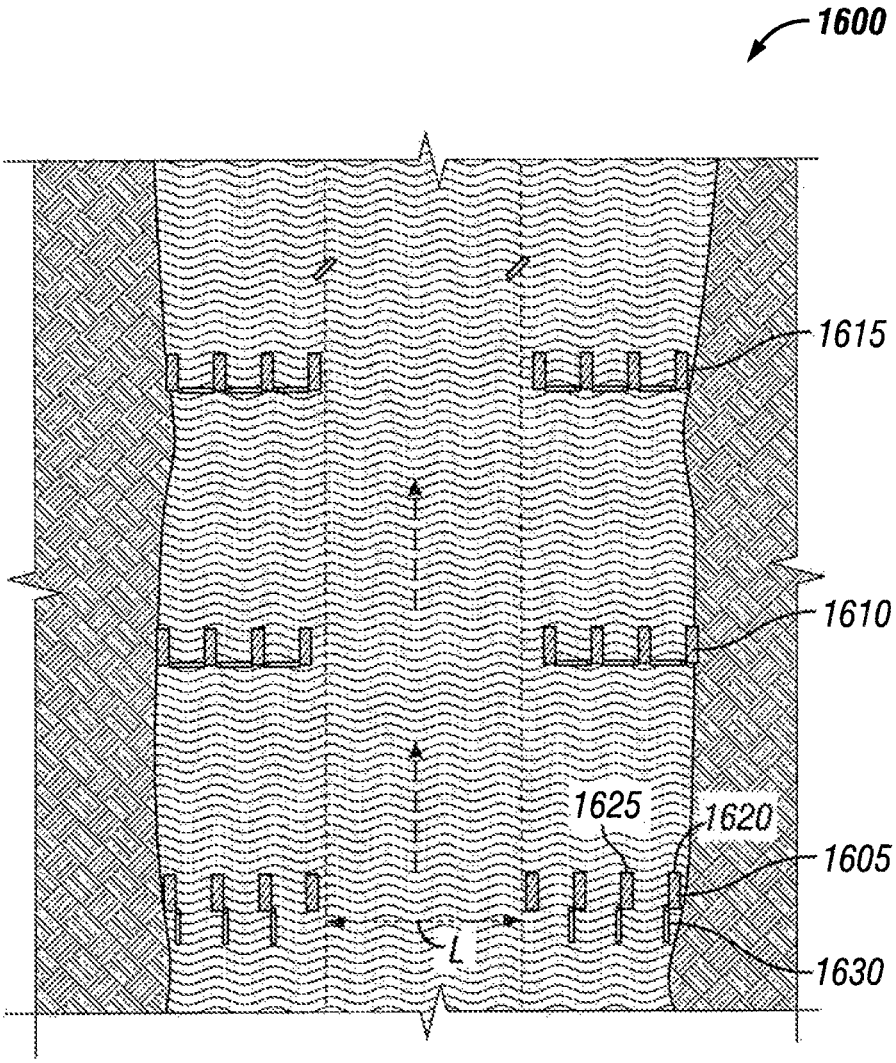
FIG. 16 illustrates a top view of an exemplary layout of a plurality of open dike systems positioned along a river in dual sided, symmetric rows according to an embodiment of the present invention as a breakwater solution.

Referring to FIGS. 16-18, the operation of the open dike system is described to fully elaborate the nature of the present invention and the differences between this invention and existing solutions.

FIG. 16 illustrates a top view of an exemplary layout of a plurality of open dike systems positioned along a river in dual sided, symmetric rows as a breakwater solution. As shown in FIG. 16, the plurality of open dike systems comprises a first open system row 1605, a second open dike system row 1610 and an optional third open dike system row 1615. The first 1605, second 1610 and optional third rows 1615 may be positioned along the river in dual sided, symmetric rows, leaving a navigable channel L unobstructed. As shown in FIG. 16, the navigable channel L can be controlled based on the layout of the plurality of open dike systems, as the system does not depend on an open or a closed condition of the flap gate, water vehicles can move freely within the navigable channel L. In an embodiment, the navigable channel L may be about 160 meters.

In an embodiment, the open dike system row 1605 further comprises a first open dike system 1620, a second open dike system 1625 and a flap gate 1630 disposed between the first dike system 1620 and the second dike system 1625.

At low tide, the flap gate 1630 is opened to allow discharge water to flow freely downstream. During a rainy season, the flap gate 1630 will only be closed for a few to several hours during high tide of the day. However, during a dry season, the flap gate 1630 may only be closed for a short period of time or not at all.

Such function creates the biggest advantage of this open dike system which causes little to no damage to the water flow (and environment). The floating materials, sediment and waste in the river water flow freely downstream. As such, the self-purification, sedimentation upstream of the system does not alter the natural cycle. This is an advantage that the existing solid breakwater systems cannot provide.

Figure 17A:
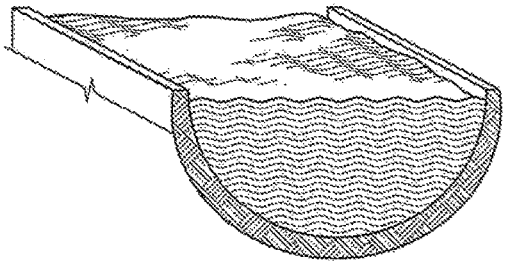
FIG. 17A PRIOR ART
FIG. 17A illustrates a cross-sectional view of a river in its original state, wherein the river's volumetric flow is not obstructed or reduced.
Figure 17B:
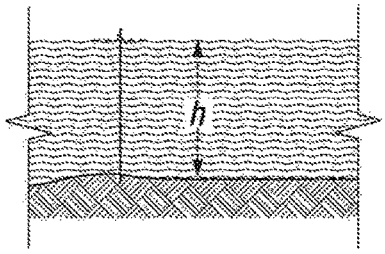
FIG. 17B illustrates a cross-sectional view of the river in FIG. 17A, showing the river water level (h) without an open dike system according to the present invention.
Figure 17C:
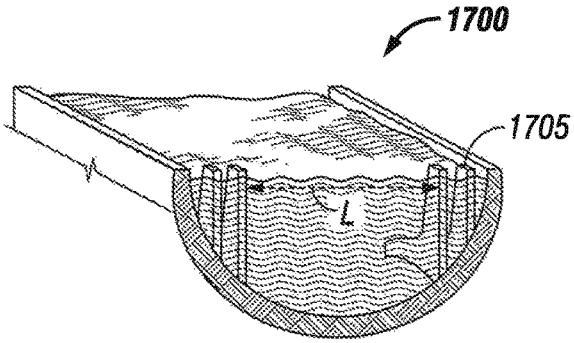
FIG. 17C illustrates a cross-sectional view of an exemplary layout of a plurality of open dike systems positioned on the river of FIG. 17A in a dual sided, symmetric row according to an embodiment of the present invention, wherein the rivers natural volumetric flow is restricted and reduced.
Figure 17D:
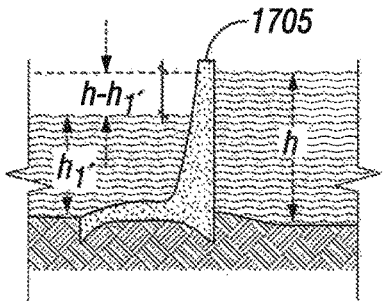
FIG. 17D illustrates the cross-sectional view of the exemplary layout in FIG. 17C, showing a difference ($h-h_1$) in the river water levels due to the plurality of open dike systems.
Figure 17E:
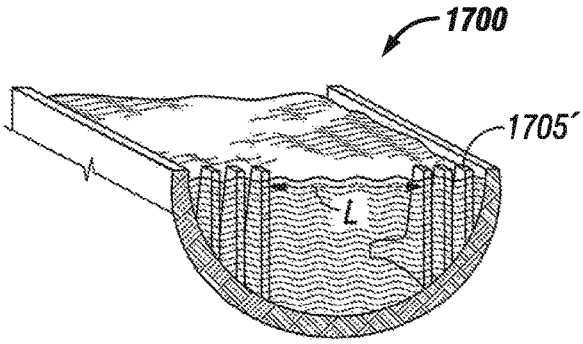
FIG. 17E illustrates a cross-sectional view of an exemplary layout of a plurality of open dike systems positioned on the river of FIG. 14A in a dense, dual sided, symmetric row according to an embodiment of the present invention, wherein the river's natural volumetric flow is further restricted and reduced.
Figure 17F:
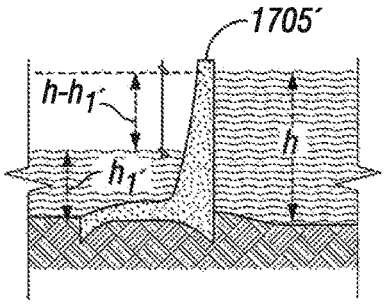
FIG. 17F illustrates the cross-sectional view of the exemplary layout in FIG. 17E, showing a greater difference ($h-h_1'$) in the river water levels due to the increased density of the plurality of open dike systems.
Figure 18:
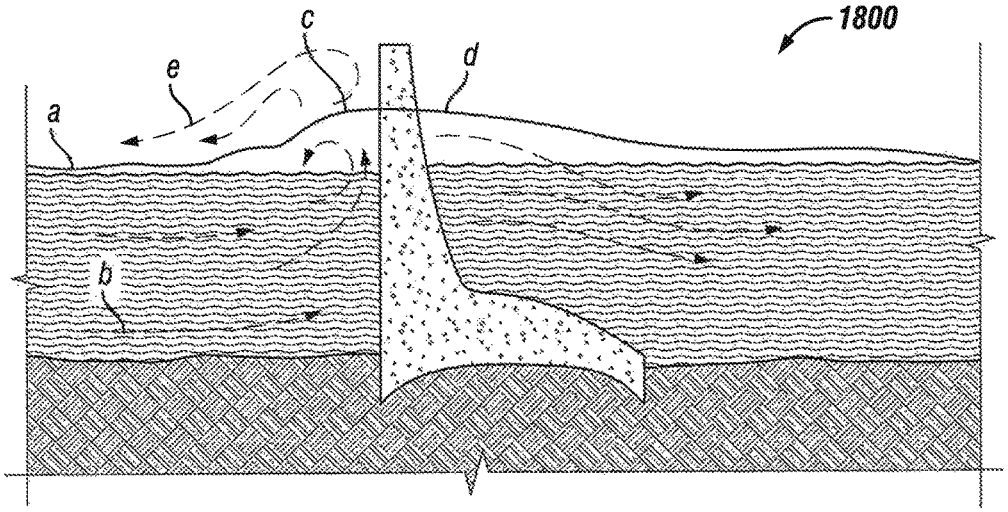
FIG. 18 illustrates a side view of an exemplary open dike system positioned on a river according to an embodiment of the present invention, showing illustrative flow patterns downstream and upstream of the open dike system.

Referring to FIG. 17A 17F, the water level upstream of the open dike system may be controlled through positioning the width of gap (e.g., navigable channel) on a river by installing more or less open dike equipment ($h1<h2<h$). The natural river bottom should be cleared and leveled (if necessary) to provide a suitable ground for the equipment (see e.g., FIG. 15).

As shown in FIG. 15, the open dike equipment 1500, comprising the base section 1502 with anchor feet 1512, and the wall section 1514, is positioned on the river bottom. The structure of the base section 1502 may be designed with anchor feet 1512 so that the horizontal force of the water cannot topple the equipment. As such, an advantage of this open dike system is less expensive material supplies, ease of construction on land, and ability to transport equipment to desired location. In other words, the open dike equipment does not need to be constructed underwater.

FIG. 17A illustrates a cross-sectional view of a river at its original state with a wide aperture, wherein the river volumetric flow is not obstructed or reduced; and FIG. 17C illustrates a cross-sectional view of an exemplary layout of a plurality of open dike systems positioned on the river of FIG. 17A in a dual sided, symmetrical row, wherein the natural river volumetric flow is restricted and reduced upstream of the system. As shown in FIG. 17C, the plurality of open dike systems 1700 comprises a first open dike system row 1705. The first open dike system row 1705 is positioned along the river in a dual sided, symmetric row, leaving a navigable channel L unobstructed. In an embodiment, the navigable channel L may be about 160 meters.

FIG. 17B illustrates a cross-sectional view of the river in FIG. 17A, showing the river water level (h) without the plurality of open dike systems; and FIG. 17D illustrates the cross sectional view of the exemplary layout in FIG. 17C, showing a difference ($h-h_1$) in the river water levels due to the open dike system row 1705.

To further restrict the natural river volumetric flow, the open dike system may be positioned more densely in the row. FIG. 17E illustrates a cross-sectional view of an exemplary layout of a plurality of open dike systems positioned on the river of FIG. 17A in a dense, dual sided, symmetric row, wherein the river's natural volumetric flow is further restricted and reduced than in the example of FIGS. 17C and 17D. As shown in FIG. 17E, the plurality of open dike systems 1700 comprises a first open dike system row 1705'. The first open dike system row 1705' is positioned along the river in a dense, dual sided, symmetric row, leaving a navigable channel L unobstructed. In an embodiment, the navigable channel L may be about 160 meters.

FIG. 17F illustrates the cross-sectional view of the exemplary layout in FIG. 17E, showing a greater difference ($h-h_1'$) in the river water levels due to the increased density of the open dike system row 1705'.

FIG. 18 illustrates a side view of an exemplary open dike system, showing illustrative flow patterns downstream and upstream of the system. As shown in FIG. 18, (a) is the tide water level downstream of the open dike system, (b) is the direction of the tide water flow (and also momentum vector of the flow before contacting the system), (c) is a high water level downstream of the system due to the partially blocked water flow, (d) is a potential energy of the high water level before the system, and (e) is the momentum vector of the water flow being upturned vertically when contacting the system, causing the water level before the system to rise. When the water flow is partially blocked by the system, the momentum vector (b) is redirected from being about parallel with the river bottom to being upturned vertically. This creates a potential energy (d) higher than the tide water level (a), causing the water velocity flowing through the system to increase. However, the increased potential energy from the upturned water flow (e) is higher than the potential energy of the high water level before the system (d). This effect causes water velocity before the system to decrease as well.

FIGS. 19A-19D illustrate top views of exemplary layouts of a plurality of open dike systems positioned along a river, showing illustrative water flow patterns due to the layout. The plurality of open dike systems should be positioned to sequentially reduce flow pressure, and, therefore, flow velocity, between adjacent chevrons or rows. For example, a first open dike system chevron or row partially blocks the flow velocity, causing a higher water level at the first chevron or row. The higher water levels (i.e., higher potential energy) increase the downstream flow velocity, causing whirlpools and friction against the river bottom and sides. These whirlpools and friction release potential energy contained in the flow momentum and, therefore, reduce the flow pressure (i.e., lowering both momentum energy and flow velocity). The above described operation creates the "pressure lowering zone effect" between two adjacent chevrons or rows as illustrated in FIGS. 20-21.

Figure 20:
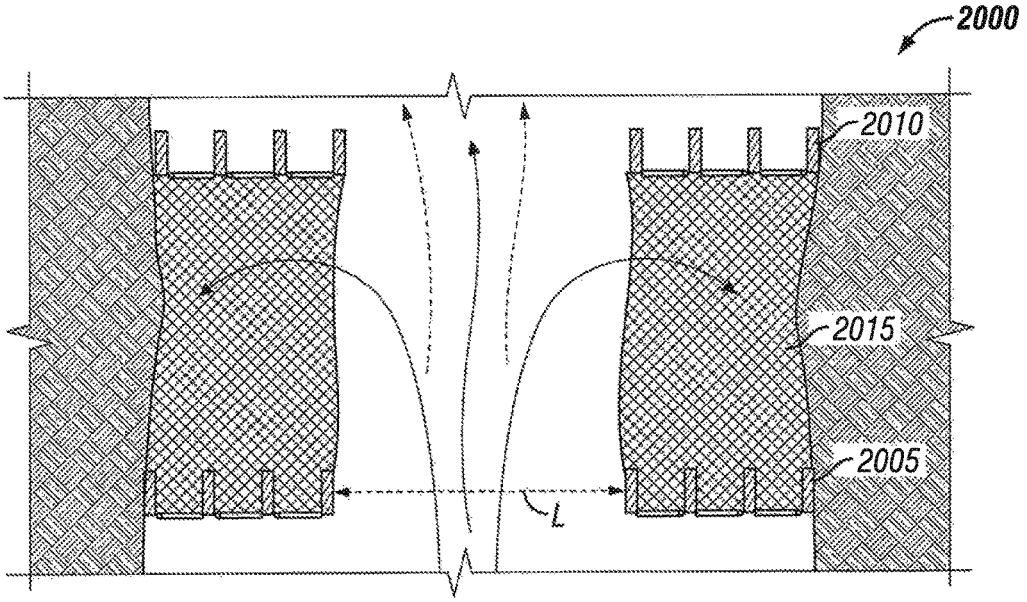
FIG. 20 illustrates a top view of an exemplary layout of a plurality of open dike systems along a river in dual sided, symmetric rows according to an embodiment of the present invention, showing a "pressure lowering zone effect" between two adjacent rows.

FIG. 20 illustrates a top view of an exemplary layout of a plurality of open dike systems along a river in symmetrical rows, showing the "pressure lowering zone effect" between two adjacent rows. As shown in FIG. 20, the layout 2000 comprises a first open dike row 2005, and a second open dike row 2010. The first 2005 and second open dike rows 2010 may be positioned along the river in dual sided, symmetric rows, leaving a navigable channel L unobstructed. A pressure lowering zone 2015 is located between the first 2005 and second adjacent open dike rows 2010.

Figure 21:
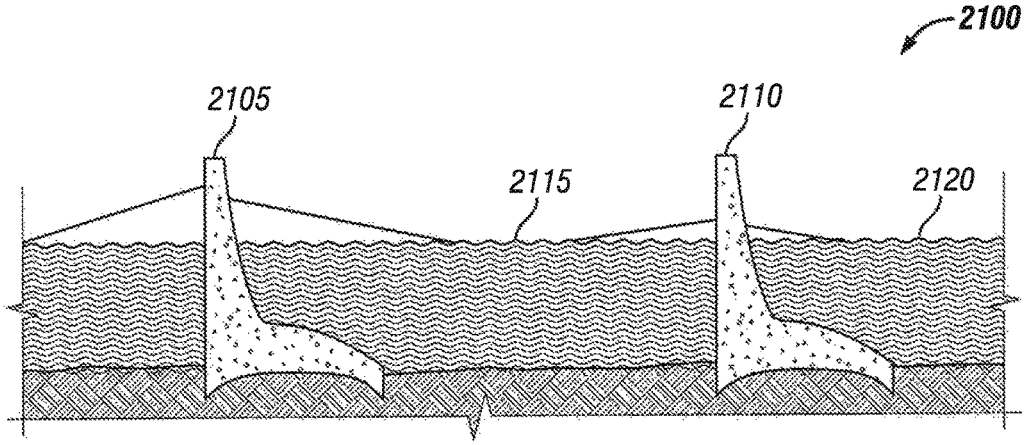
FIG. 21 illustrates a cross-sectional view of an exemplary layout of a plurality of open dike systems along a river, showing a "pressure lowering zone effect" for 1 time to n times.

FIG. 21 illustrates a cross-sectional view of an exemplary layout of a plurality of open dike systems positioned along a river, showing the "pressure lowering zone effect" for 1 time to n times. As shown in FIG. 21, the layout 2100 comprises a first open dike system 2105 and a second open dike system 2110. A first pressure lowering zone 2115 is located between the first 2105 and second adjacent open dike systems 2110; and a second pressure lowering zone 2120 is located between the second 2110 and third adjacent open dike rows (not shown).

FIG. 19A illustrates a top view of an exemplary "scheme 1" layout of a plurality of open dike systems positioned along a river in dual sided, symmetric rows. As shown in FIG. 19A, the layout 1900 comprises a first open dike row 1905, a second open dike row 1915 and an optional third open dike row 1920. The first 1905, second 1915 and optional third open dike rows 1920 may be positioned along the river in dual sided, symmetric rows, leaving a navigable channel L unobstructed.

FIG. 19B illustrates a top view of an exemplary "scheme 2" layout of a plurality of open dike systems positioned along a river in dual sided, symmetric chevrons. As shown in FIG. 19B, the layout 1900 comprises a first open dike chevron 1905', a second open dike chevron 1915' and an optional third open dike chevron 1920'. The first 1905', second 1915' and optional third open dike chevrons 1920' may be positioned along the river in dual sided, symmetric chevrons, leaving a navigable channel L unobstructed.

FIG. 19C illustrates a top view of an exemplary "scheme 3" layout of a plurality of open dike systems positioned along a river in asymmetric rows. As shown in FIG. 19C, the layout 1900 comprises a first open dike row 1905, a second open dike row 1915 and a third open dike row 1920. The first 1905, second 1915 and third open dike rows 1920 may be positioned along the river in dual sided, asymmetric rows, leaving an S shaped navigable channel L unobstructed.

Figure 19D:
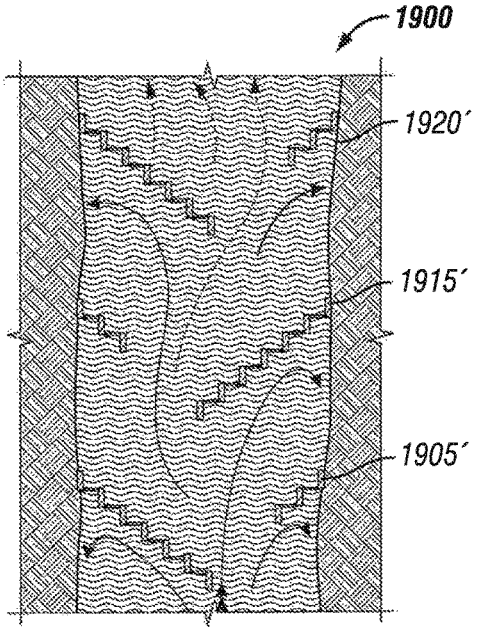
FIG. 19D illustrates a top view of an exemplary "scheme 4" layout of a plurality of open dike systems positioned along a river in dual sided, asymmetric chevrons according to an embodiment of the present invention, showing illustrative water flow patterns due to the layout.

FIG. 19D illustrates a top view of an exemplary "scheme 4" layout of a plurality of open dike systems positioned along a river in asymmetric chevrons, showing illustrative water flow patterns due to the layout. As shown in FIG. 19D, the layout 1900 comprises a first open dike chevron 1905', a second open dike chevron 1915' and a third open dike chevron 1920'. The first 1905', second 1915' and third open dike chevrons 1920' are positioned along the river in dual sided, asymmetric chevrons, leaving an S shaped navigable channel L unobstructed.

Layouts of Open Dike Systems as River Bottom Protection

Figure 22A:
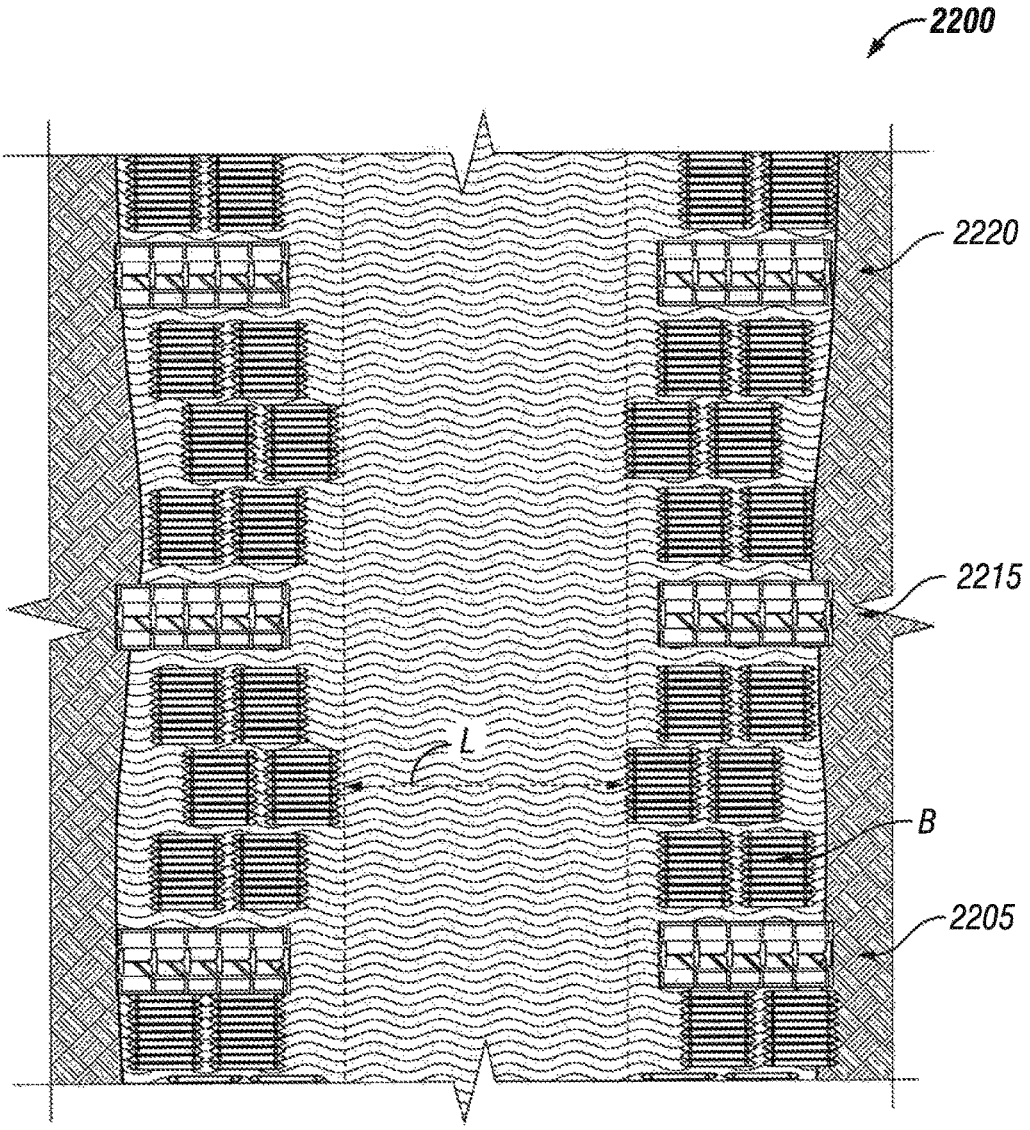
FIG. 22A illustrates a top view of an exemplary "scheme 1" layout of a plurality of open dike systems positioned along a river in dual sided, symmetric rows according to an embodiment of the present invention as a river bottom protection solution.
Figure 22B:
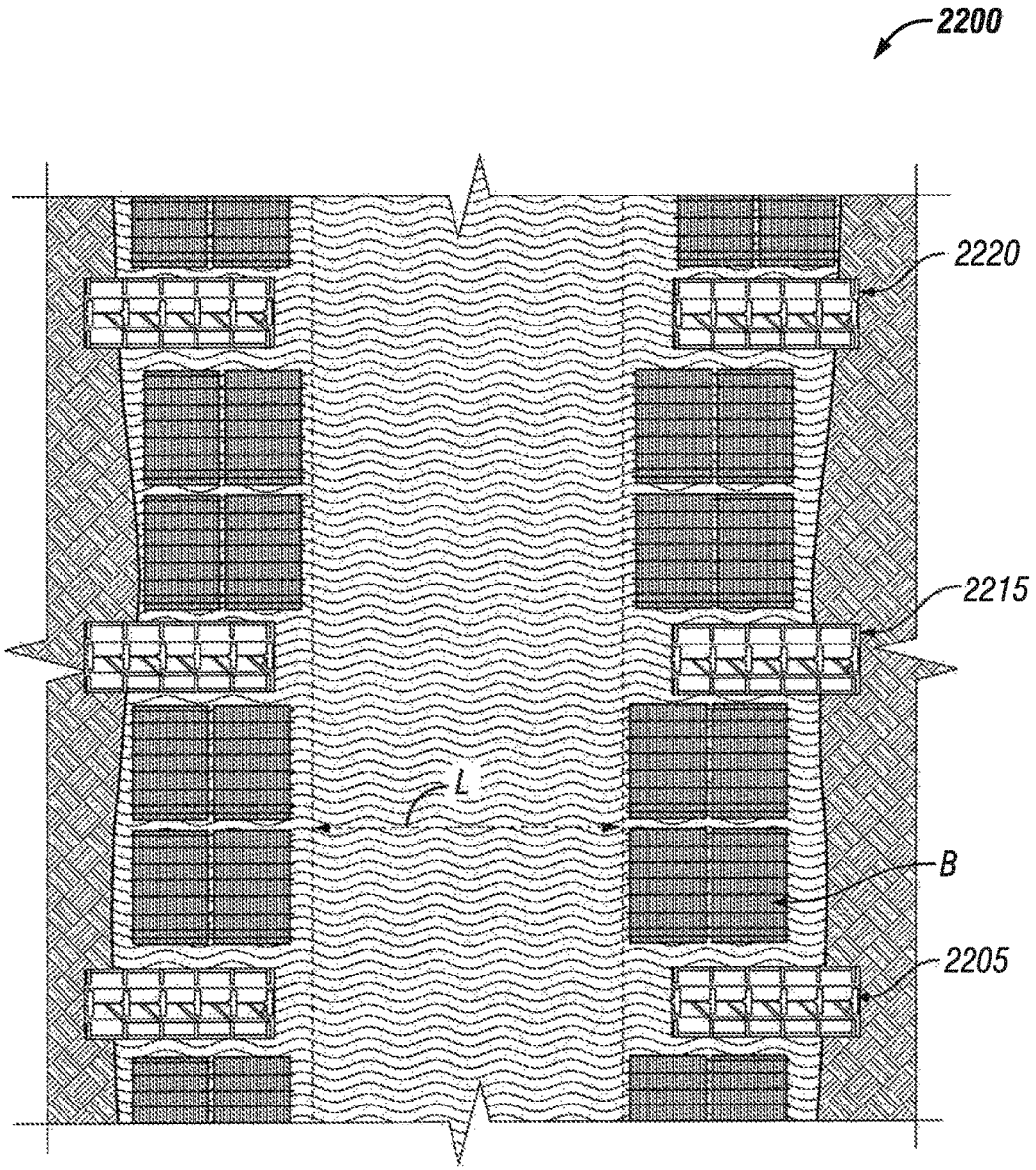
FIG. 22B illustrates a top view of an exemplary "scheme 2" layout of a plurality of open dike systems positioned along a river in dual sided, symmetric rows according to an embodiment of the present invention as a river bottom protection solution.
Figure 22C:
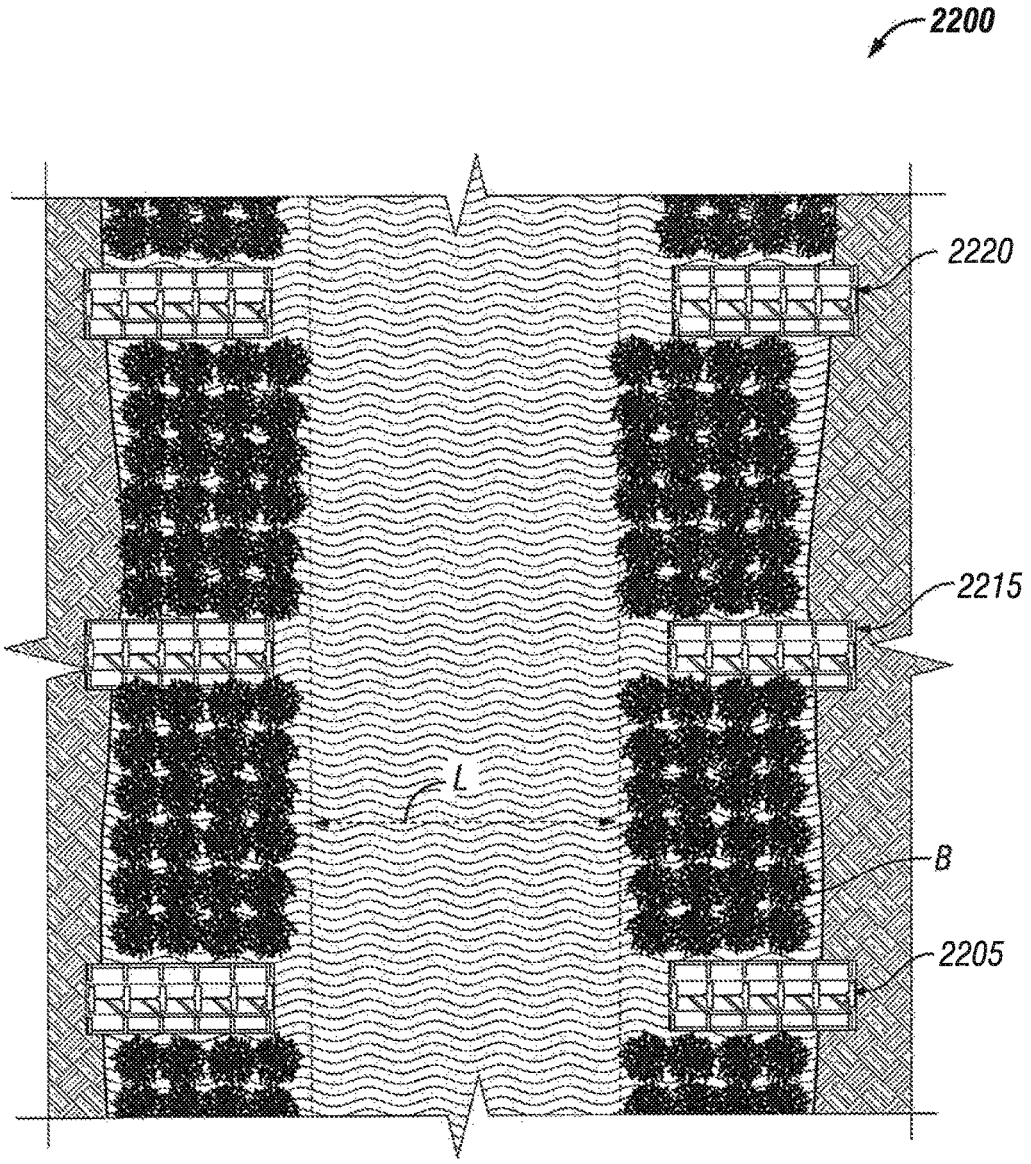
FIG. 22C illustrates a top view of an exemplary "scheme 3" layout of a plurality of open dike systems positioned along a river in dual sided, symmetric rows according to an embodiment of the present invention as a river bottom protection solution.

FIGS. 22A-22C illustrate top views of exemplary layouts of a plurality of open dike systems along a river as a river bottom protection solution. FIG. 22A illustrates a top view of an exemplary "scheme 1" layout of a plurality of open dike systems 2200 positioned along a river in dual sided, symmetric rows. As shown in FIG. 22A, the layout 2200 comprises a first open dike system row 2205, a second open dike system row 2215 and one or more bottom protection B, wherein the one or more bottom protection B is disposed on a river bottom between the first open dike system row 2205 and the second open dike system row 2215, leaving a navigable channel L unobstructed.

FIG. 22B illustrates a top view of an exemplary "scheme 2" layout of the plurality of open dike systems positioned along a river in symmetric rows. As shown in FIG. 22B, the layout 2200 comprises the first open dike system row 2205, the second open dike system row 2215 and one or more bottom protection B, wherein the one or more bottom protection B is disposed on a river bottom between the first open dike system row 2205 and second open dike system row 2215, leaving the navigable channel L unobstructed.

FIG. 22C illustrates a top view of an exemplary "scheme 3" layout of the plurality of open dike systems positioned along a river in symmetric rows. As shown in FIG. 22C, the layout 2200 comprises the first open dike system row 2205, the second open dike system row 2215 and one or more bottom protection B, wherein the one or more bottom protection B is grown on a river bottom between the first open dike system row 2205 and second open dike system row 2215, leaving the navigable channel L unobstructed.

The bottom protection B may be any suitable structure.

The bottom protection B may be constructed or grown in any suitable shape. Suitable shapes include, but are not limited to, cone, cube, cuboid, cylinder, hexagonal prism, square based pyramid, sphere, triangular based pyramid, triangular prism and variations thereof. In an embodiment, the bottom protection B may be a variation of a cuboid shape. (See e.g., FIGS. 22A-22B). In an embodiment, the bottom protection B may be a variation of a sphere shape. (See e.g., FIG. 22C).

The bottom protection B may be constructed or grown of any suitable material. Suitable materials include, but are not limited to, biological materials (e.g., bamboo, vegetation, wood), non-biological materials (e.g., composites, concrete, metals and polymers), and combinations thereof. In an embodiment, the bottom protection B may be constructed of composites, concrete, metals, polymers, and combinations thereof. In an embodiment, the bottom protection B may be constructed of biological materials (e.g., bamboo, wood (see e.g., FIG. 22A)) or grown from biological materials (e.g., vegetation (see e.g., FIG. 22C)). In an embodiment, the bottom protection B may be constructed of non-biological materials (e.g., composites, concrete, metals and polymers). (See e.g., FIG. 22B).

Layout and Operation of Open Dike Systems as Storm Surge Protection

Figure 23A:
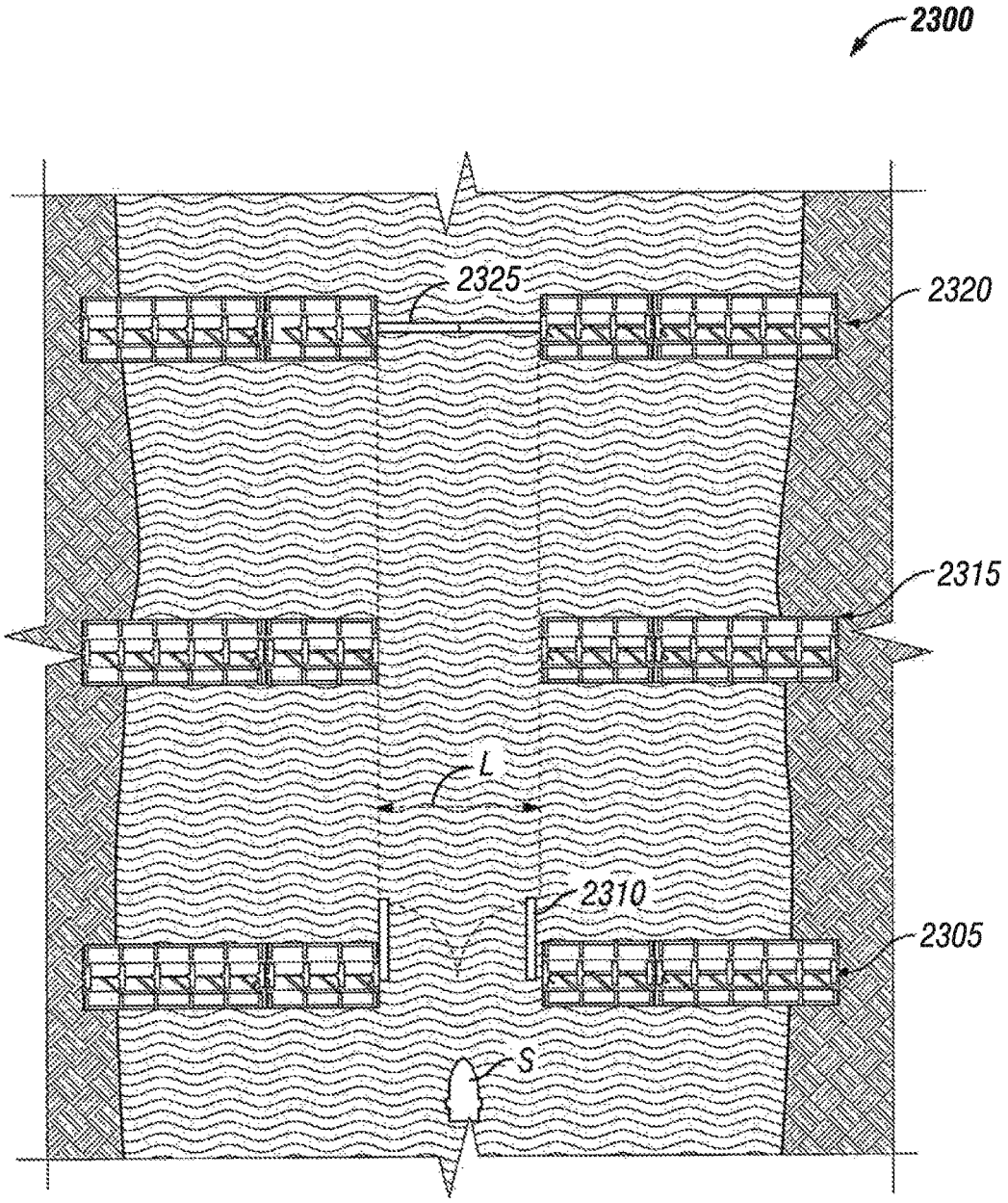
FIG. 23A illustrates a top view of an exemplary layout of a plurality of open dike systems positioned along a river in dual sided, symmetric rows with a first flap gate installed between a first pair of open dike systems and a third flap gate installed between a third pair of open dike systems according to an embodiment of the present invention as a storm surge solution, showing the first flap gate in an open position to allow small boats to travel along the river.
Figure 23B:
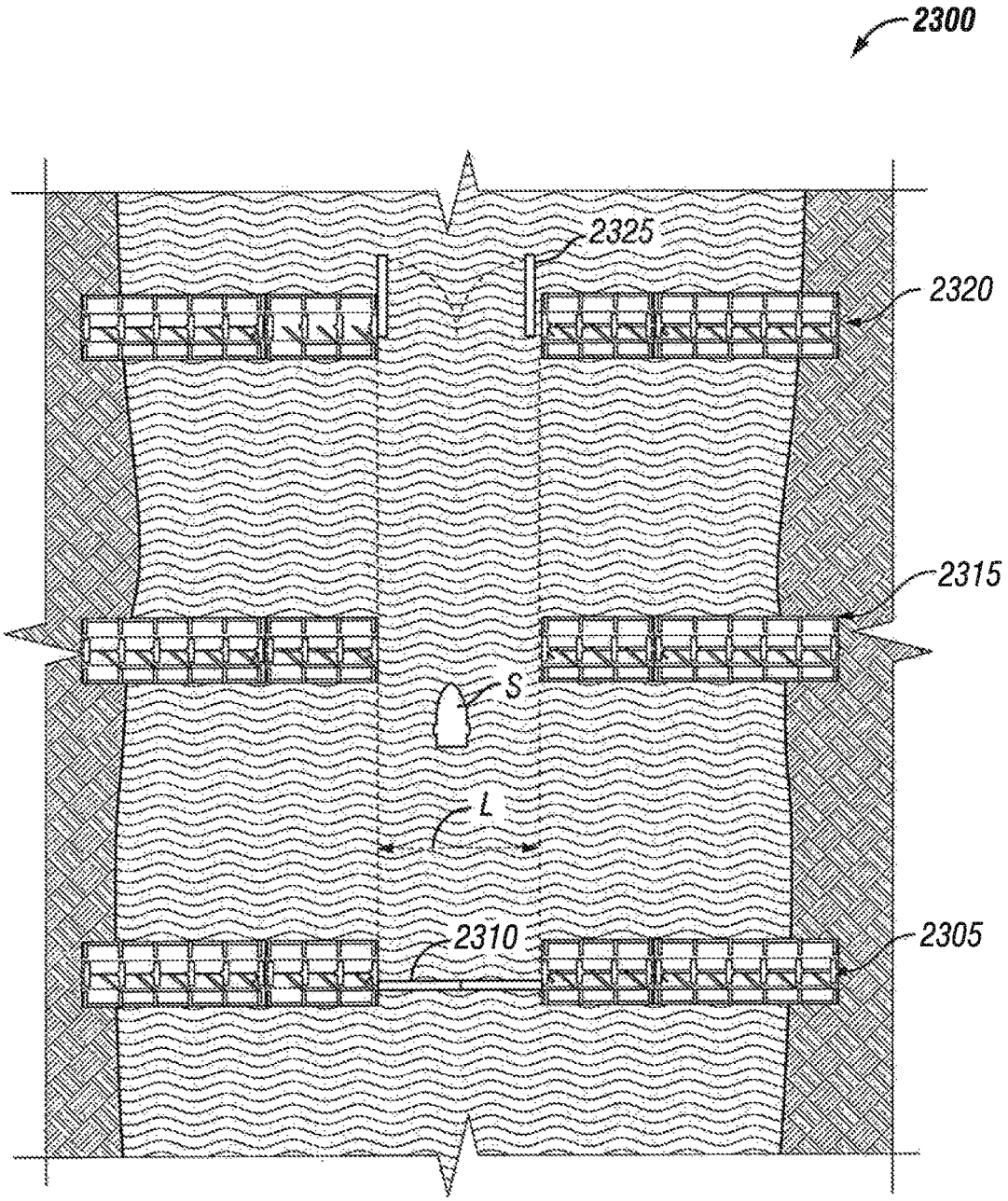
FIG. 23B illustrates the top view of the exemplary layout in FIG. 23A, showing the third flap gate in an open position to allow small boats to travel along the river.
Figure 23C:
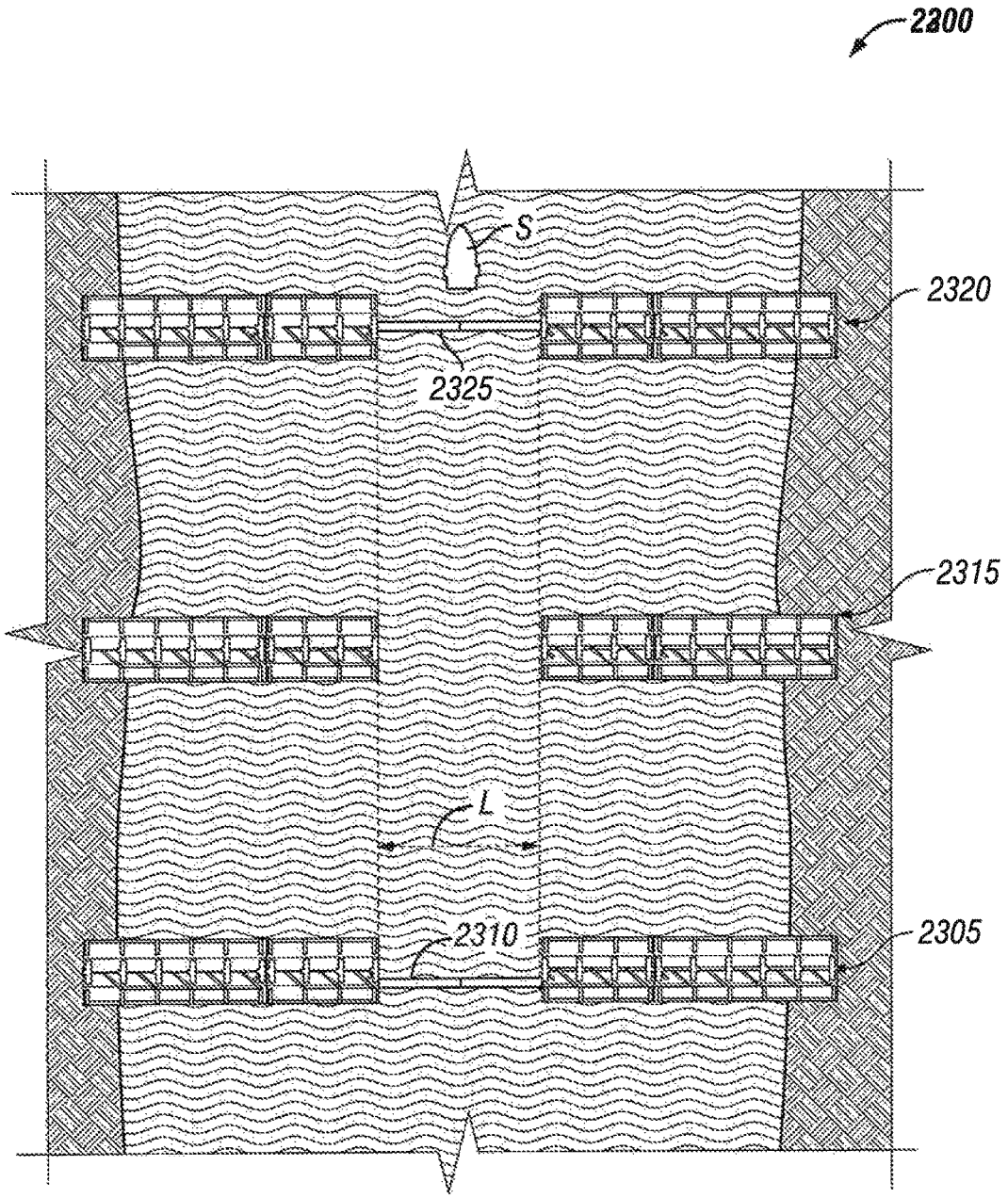
FIG. 23C illustrates the top view of the exemplary layout in FIG. 23A, showing the first and third flap gates in a closed position to prevent a storm surge from traveling upstream.

FIGS. 23A-23C illustrate a top view of an exemplary layout and operation of a plurality of open dike systems as a storm surge solution. As shown in FIG. 23A, the plurality of open dike systems 2300 may be positioned along a river in dual sided, symmetrical rows, namely, a first open dike system row 2305, a second open dike system row 2315 and a last open dike system row 2320. When a large ship S enters a river at high tide, a first flap gate 2310 across a navigable channel L between opposing first open dike systems on the first row 2305 will open to allow the ship S to pass while a last flap gate 2325 across the navigable channel L between opposing last open dike systems in the last row 2320 will remain closed until the ship S approaches the last flap gate 2325. As shown in FIG. 23B, after the ship S has passed through the first row 2305, the first flap gate 2310 between the first row 2305 will close while the last flap gate 2325 across the navigable channel L between the last row 2320 will open to allow the ship S to continue down river. As shown in FIG. 23C, after the ship S has passed through the last row 2320, the last flap gate 2325 between the last row 2320 will close.

Method of Using the Open Dike Equipment and System

In an embodiment, a method of using an open dike system comprising the steps of a) using one or more open dike system, as described above; b) positioning the one or more open dike system in a layout along a river; and c) reducing tide inflow volume in a river. In an embodiment, the method further comprises the steps of d) positioning one or more flap gates across a navigable channel in a dual sided open dike system, wherein the layout in step b) is selected from the group consisting of dual sided, asymmetric chevrons, dual sided asymmetric rows, dual sided symmetric chevrons, dual sided symmetric rows and combinations thereof; and e) opening the one or more flap gates to allow large ships or water vehicles to travel upstream.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms (e.g., "outer" and "inner," "upper" and "lower," "first" and "second," "internal" and "external," "above" and "below" and the like) are used as words of convenience to provide reference points and, as such, are not to be construed as limiting terms.

The embodiments set forth herein are presented to best explain the present invention and its practical application and to thereby enable those skilled in the art to make and utilize the invention. However, those skilled in the art will recognize that the foregoing description has been presented for the purpose of illustration and example only. The description as set forth is not intended to be exhaustive or to limit the invention to the precise form disclosed. Many modifications and variations are possible in light of the above teaching without departing from the spirit and scope of the following claims. The invention is specifically intended to be as broad as the claims below and their equivalents.

Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

DEFINITIONS

As used herein, the terms "a," "an," "the," and "said" mean one or more, unless the context dictates otherwise.

As used herein, the term "about" means the stated value plus or minus a margin of error or plus or minus 10% if no method of measurement is indicated.

As used herein, the term "or" means "and/or" unless explicitly indicated to refer to alternatives only or if the alternatives are mutually exclusive.

As used herein, the terms "comprising," "comprises," and "comprise" are open ended transition terms used to transition from a subject recited before the term to one or more elements recited after the term, where the element or elements listed after the transition term are not necessarily the only elements that make up the subject.

As used herein, the terms "containing," "contains," and "contain" have the same open ended meaning as "comprising," "comprises," and "comprise," provided above.

As used herein, the terms "having," "has," and "have" have the same open ended meaning as "comprising," "comprises," and "comprise," provided above.

As used herein, the terms "including," "includes," and "include" have the same open ended meaning as "comprising," "comprises," and "comprise," provided above.

As used herein, the phrase "consisting of" is a closed transition term used to transition from a subject recited before the term to one or more material elements recited after the term, where the material element or elements listed after the transition term are the only material elements that make up the subject.

As used herein, the term "simultaneously" means occurring at the same time or about the same time, including concurrently.

INCORPORATION BY REFERENCE

All patents and patent applications, articles, reports, and other documents cited herein are fully incorporated by reference to the extent they are not inconsistent with this invention.

What is claimed is:

1. Open dike system comprising:

a dike body having a first end and a second end and a first side and a second side;

a plurality of anchor feet, wherein the plurality of anchor feet are connected to or integral with a bottom surface of the dike body;

a first pillar connected to or integral with an upper surface along the first end or the first side of the dike body;

a second pillar connected to or integral with the upper surface of the dike body offset from and approximately parallel to the first pillar;

a first flap gate rotationally, vertically attached to the first pillar and disposed between the first and second pillars, wherein the first flap gate closes against a first extension in the second pillar; and a means for opening and closing one or more flap gates, wherein the means for opening and closing the one or more flap gates opens and closes the first flap gate.

2. The open dike system of claim 1, further comprising:

a third pillar connected to or integral with the upper surface of the dike body offset from and approximately parallel to the second pillar;

a second flap gate rotationally, vertically attached to the second pillar and disposed between the second and third pillars, wherein the second flap gate closes against a second extension in the third pillar, and wherein the means for opening and closing the one or more flap gates opens and closes the second flap gate.

3. The open dike system of claim 2, wherein the means for opening and closing the one or more flap gates comprises:

a flap gate rotor having a rotational shaft attached to the first pillar;

a first flexible arm structure having a first end and a second end, wherein the first end of the flexible arm structure is attached to the rotational shaft of the flap gate rotor and the second end of the flexible arm structure is flexibly attached to the first flap gate; and a second flexible arm structure having a first end and a second end, wherein the first end of the second flexible arm structure is flexibly attached to the first flap gate and the second end of the second flexible arm structure is flexibly attached to the second flap gate.

4. The open dike system of claim 1, wherein the dike body is constructed as a hollow structure, a solid structure or a dense solid structure.

5. The open dike system of claim 1, wherein the dike body is constructed as a hollow or solid structure capable of functioning as a packet boat.

6. The open dike system of claim 1, wherein the dike body is constructed as a dense solid structure.

7. The open dike system of claim 1, wherein one or more of the plurality of anchor feet, the dike body, the first pillar and the second pillar are constructed of biological materials, non-biological materials, and combinations thereof.

8. The open dike system of claim 1, wherein one or more of the plurality of anchor feet, the dike body, the first pillar and the second pillar are constructed of composites, concrete, metals, polymers, and combinations thereof.

9. The open dike system of claim 1, wherein the first flap gate is constructed as a single, a two part or a multi-part structure.

10. The open dike system of claim 9, wherein the first flap gate has a two part structure, wherein the means for opening and closing the one or more flap gates opens and closes a lower part of the first flap gate, and wherein water force opens and closes an upper part of the first flap gate.

11. The open dike system of claim 1, wherein the first flap gate is constructed of cavitation resistant material.

12. The open dike system of claim 1, wherein the first flap gate is constructed of vulcanized rubber.

13. The open dike system of claim 1, wherein the means for opening and closing the one or more flap gate comprises:

a flap gate rotor having a rotational shaft attached to the first pillar; and a flexible arm structure having a first end and a second end, wherein the first end of the flexible arm structure is attached to the rotational shaft of the flap gate rotor and the second end of the flexible arm structure is flexibly attached to the first flap gate.

14. The open dike system of claim 13, wherein the flap gate rotor is controlled by electricity, hydraulics, water force, and combinations thereof.

15. The open dike system of claim 1, further comprising:

a first trash net and a first structural frame, wherein the first trash net is attached to the first structural frame and the first structural frame is attached to an upper surface along the first side of the dike body; and a second trash net and a second structural frame, wherein the second trash net is attached to the second structural frame and the second structural frame is attached to an upper surface along the second side of the dike body.

16. The open dike system of claim 15, wherein the first structural frame is offset from an edge of the first side of the dike body and the second structural frame is offset from an edge of the second side of the dike body to both be positioned more closely to the first flap gate.

17. A method of using an open dike system comprising the steps of:

a) using two or more open dike system of claim 1;

b) positioning the two or more open dike system in a layout having a navigable channel along a river, wherein the navigable channel is about 160 meters; and c) reducing tide inflow volume in the river to less than or equal to about 40% while maintaining outflow volume at greater than or equal to about 90%.

18. The method of claim 17, wherein the layout in step b) is selected from the group consisting of dual sided, asymmetric chevrons, dual sided asymmetric rows, dual sided symmetric chevrons, dual sided symmetric rows, single sided rows, single sided chevrons, and combinations thereof.

19. The method of claim 17, wherein step c) comprises reducing tide inflow volume in the river to less than or equal to about 30% while maintaining outflow volume at greater than or equal to about 95%.

20. The method of claim 17, further comprising the steps of:

d) positioning a third flap gate across a navigable channel between a first open dike system and a second open dike system, wherein the third flap gate is rotationally, vertically attached to a first pillar of the first open dike system and the third flap gate closes against a second pillar of the second open dike system, and wherein the layout in step b) is selected from the group consisting of dual sided, asymmetric chevrons, dual sided asymmetric rows, dual sided symmetric chevrons, dual sided symmetric rows, and combinations thereof; and e) opening the one or more flap gates to allow large ships or water vehicles to travel upstream.

21. The method of claim 17, wherein step b) further comprises using bottom protection downstream or upstream of the two or more open dike systems.

22. The method of claim 17, wherein step a) comprises the open dike system of claim 1, further comprising:

a third pillar connected to or integral with the upper surface of the dike body offset from and approximately parallel to the second pillar;

a second flap gate rotationally, vertically attached to the second pillar and disposed between the second and third pillars, wherein the second flap gate closes against a second extension in the third pillar, and wherein the means for opening and closing the one or more flap gates opens and closes the second flap gate.

23. The method of claim 17, wherein the dike body is constructed as a hollow structure, a solid structure or a dense solid structure.

24. The method of claim 17, wherein the dike body is constructed as a hollow or solid structure capable of functioning as a packet boat.

25. The method of claim 17, wherein the dike body is constructed as a dense solid structure.

* * * * *